US008317563B2

(12) United States Patent
Yamauchi et al.

(10) Patent No.: US 8,317,563 B2
(45) Date of Patent: Nov. 27, 2012

(54) METHOD FOR PRODUCING PLASMA DISPLAY PANEL

(75) Inventors: Yasuhiro Yamauchi, Osaka (JP); Masahiro Sakai, Kyoto (JP); Yusuke Fukui, Osaka (JP); Keisuke Okada, Osaka (JP)

(73) Assignee: Panasonic Corporation, Osaka (JP)

( * ) Notice: Subject to any disclaimer, the term of this patent is extended or adjusted under 35 U.S.C. 154(b) by 101 days.

(21) Appl. No.: 13/063,174

(22) PCT Filed: May 18, 2010

(86) PCT No.: PCT/JP2010/003336

§ 371 (c)(1),
(2), (4) Date: Mar. 9, 2011

(87) PCT Pub. No.: WO2010/140307

PCT Pub. Date: Dec. 9, 2010

(65) Prior Publication Data

US 2011/0165818 A1 Jul. 7, 2011

(30) Foreign Application Priority Data

Jun. 2, 2009 (JP) ..... 2009-132973

(51) Int. Cl.
*H01J 9/20* (2006.01)
*H01J 9/26* (2006.01)

(52) U.S. Cl. ..... 445/25; 445/24

(58) Field of Classification Search ..... 445/24–25; 313/582–587

See application file for complete search history.

(56) References Cited

U.S. PATENT DOCUMENTS

| | | | |
|---|---|---|---|
| 2002/0024295 | A1 | 2/2002 | Miyashita et al. |
| 2003/0073372 | A1 | 4/2003 | Nakatake et al. |
| 2006/0033686 | A1 | 2/2006 | Kawase et al. |

FOREIGN PATENT DOCUMENTS

| | | |
|---|---|---|
| JP | 10-302635 | 11/1998 |
| JP | 2000-082401 | 3/2000 |
| JP | 2002-008533 | 1/2002 |
| JP | 2003-086101 | 3/2003 |
| JP | 2003-123647 | 4/2003 |

(Continued)

OTHER PUBLICATIONS

Yasushi Motoyama et al., "Efficiency Improvement for PDPs Using the Low-Voltage SrCaO Protective Layer", NHK Giken R&D, No. 103, May 2007, pp. 32-39 (with English abstract only).

*Primary Examiner* — Anh Mai
*Assistant Examiner* — Elmito Breval

(57) ABSTRACT

Provided is a manufacturing method that allows even a PDP having high-definition cells to exhibit excellent image display performance with reduced power consumption by effectively preventing impurities from adhering to the protective layer. Specifically, in a pre-baking step, a back substrate 9 is baked at a pre-baking temperature. Here, a highest pre-baking temperature is set to be lower than a softening point of a sealing material. The back substrate 9 is superposed on a front substrate 2. Then, a sealing step is performed in a sealing atmosphere prepared by mixing a predetermined amount of a reducing gas with a non-oxidizing gas. The above enables the impurities attributed to organic components due to a sealing material paste to remain as low molecular components, whereby the impurities are evacuated and removed in an evacuating step performed after the sealing step. This prevents adherence of the impurities to the protective layer 8.

15 Claims, 14 Drawing Sheets

FOREIGN PATENT DOCUMENTS

| | | |
|---|---|---|
| JP | 2003-131580 | 5/2003 |
| JP | 2004-146231 | 5/2004 |
| JP | 2005-070381 | 3/2005 |
| JP | 2002-157338 | 6/2005 |
| JP | 2002-231129 | 8/2005 |
| JP | 2007-119833 | 5/2007 |
| JP | 2007-134221 | 5/2007 |
| JP | 2007-265768 | 10/2007 |
| JP | 2008-027862 | 2/2008 |
| JP | 2008-226516 | 9/2008 |
| JP | 2009-009742 | 1/2009 |
| JP | 2009-266544 | 11/2009 |
| JP | 2010-102835 | 5/2010 |
| WO | 2009/133660 | 11/2009 |

[Temperature profile in sealing step, evacuating step, and discharge gas introducing step]

METHOD FOR PRODUCING PLASMA DISPLAY PANEL

RELATED APPLICATION

The present application is a national phase application of International Application PCT/JP2010/003336 filed on May 18, 2010 which claims priority from Japanese Application No. 2009-132973 filed on Jun. 2, 2009.

TECHNICAL FIELD

The present invention relates to a manufacturing method for a plasma display panel (referred to below simply as a "PDP"), and in particular to techniques for effectively preventing impurity contamination in a protective layer and for improving a quality of the protective layer.

BACKGROUND ART

Plasma display panels (referred to below as "PDPs") have attracted attention as one type of display device used for a computer and a TV. Such a PDP is a flat display apparatus that makes use of radiation caused by gas discharge. With the PDP, high-speed and high-definition display is easily possible. Moreover, size enlargement or size and weight reduction of the PDP is easily realized. Accordingly, the PDP is widely used in fields such as video display apparatuses and public information display apparatuses (see Patent Literature 1). The PDP includes direct current (DC) and alternating current (AC) types. The AC PDP, in particular a surface discharge PDP, has a high technological potential in view of its lifetime properties and a large screen size, and therefore has been commercialized.

A conventional common AC PDP is mainly composed of a pair of substrates (i.e. front and back substrates) that are disposed in opposition to sandwich a discharge space therebetween. The front and back substrates are sealed together at the sealing portion formed along the peripheral edges thereof to enclose an inner space between the substrates. The sealing portion includes a sealing material, such as low-melting glass.

On a main surface of the front glass substrate which forms a base surface, an Ag paste is applied and baked to form display electrodes each having a pair of electrodes in a stripe pattern. Following that, a glass paste is applied over the front substrate glass on which the display electrodes have been formed, and baked to form a dielectric layer composed of lead oxide. On the surface of the dielectric layer, a MgO layer or a MgO-containing protective layer is formed by a sputtering method or the like.

On a main surface of the back glass substrate, the Ag paste is applied and baked to form address (i.e. data) electrodes in a stripe pattern. Following that, the dielectric layer is sequentially formed on the main surface of the back glass substrate by the same method as the above. Subsequently, barrier ribs in a stripe pattern are formed on the dielectric layer in a manner such that the barrier ribs partition each address electrode. The barrier ribs are formed by applying a glass paste on the dielectric layer and then baked. After the barrier ribs are formed, phosphor ink containing one of red (R), green (G) and blue (B) phosphors is applied to the lateral surface of each barrier rib and on the exposed surface of the dielectric layer between adjacent barrier ribs. The phosphor ink is then baked at 500° C. to remove a resin component from the paste, thus forming the phosphor layers.

Following that, a sealing material paste is applied along the peripheral edges of the main surface of the back substrate on which the phosphor layers have been formed. The sealing material paste is composed of a mixture of the sealing material, resin (binder), and solvent. The sealing material contains lead oxide-based glass and an oxide filler in a mixture. In the manufacturing process, the sealing material paste is heated by pre-baking, whereby organic components contained in the paste are removed to some extent. The front and back substrates are superposed and positioned, with the main surface of the front substrate on which the display electrodes have been formed opposing the main surface of the back substrate on which the address electrodes have been formed, so that the display electrodes intersect the address electrodes. With the front and back substrates positioned as mentioned above, baking (i.e. sealing) step is performed to form the sealing portion. This seals the inner space enclosed by both the substrates.

In the pair of substrates, top surfaces of the barrier ribs formed on the back substrate abut against the main surface of the front substrate. As a result, adjacent barrier ribs partition the inner space into discharge cells. Between adjacent barrier ribs is the discharge space. After the above-mentioned sealing step, the inner space enclosed by both the substrates is evacuated. Subsequently, a rare gas, such as a Ne—Xe-based or a Xe—He based gas, is enclosed as a discharge gas at a predetermined pressure (normally at 40 to 80 kPa).

In order to display an image on the PDP, the method employed is one that expresses gradations in an image by dividing one field of the image into a plurality of subfields (S.F.) (e.g. intra-field time division grayscale display method). At the time of driving of the PDP, the display and the address electrodes are supplied with a current at a predetermined timing, leading to discharge generated in the discharge space. Upon the discharge, the discharge gas is ionized, whereby vacuum UV lines (i.e. mainly, resonance radiation with a wavelength of 147 nm and molecular radiation with a wavelength of 173 nm) are generated in the discharge space. The phosphor layers are excited by the vacuum UV lines, whereby a visible light is emitted. Thus, color display is realized on the panel as a whole.

Due to recent diversification in PDP usage, various PDP standards exist. One specific example of these standards is a conventional standard (SD) panel having 852 horizontal scanning lines (in width direction) and 480 vertical scanning lines (in length direction). Another example is a high-definition (HD) panel having 1024 horizontal scanning lines and 768 vertical scanning lines. Besides, currently, a full high-definition (HD) panel which is capable of displaying an image of higher definition than the high-definition panel is manufactured, and other panels with even higher definition are under development.

Such a high-definition PDP requires increased number of pixels. For example, a 42 inch visual size full HD panel has 1920 pixels horizontally×1080 pixels vertically with a vertical cell pitch of approximately 0.16 mm. In an ultra-high-definition panel having a visual size of 50 inches, which offers higher definition than the full HD panel, the number of cells is as many as approximately 4000 discharge cells horizontally×2000 discharge cells vertically. In this case, the vertical cell pitch is as extremely small as 0.1 mm.

In order to achieve an excellent image display capability with use of the great number of small discharge cells, it is necessary to assure that necessary light emission by discharge is performed at predetermined timing. As one method for achieving this, it is known that emission luminance can be improved by increasing a partial pressure of Xe in the discharge gas (e.g. increasing the partial pressure of Xe in the Ne—Xe-based gas from conventional 10% or so to approximately 30%).

On the other hand, due to a recent demand for electrical appliances with a low electric power consumption, a PDP using only a low drive voltage is needed. However, the problem is that increasing the Xe partial pressure in the discharge gas as mentioned above often causes an increase in the discharge voltage, resulting in an increase in the electric power consumption. The increase in the drive voltage also brings about a need for a pressure-proof driver, which might lead to an increase in the cost for a drive circuit and so on. Furthermore, an increase in the discharge strength makes the protective layer exposed to the discharge more vulnerable to abrasion (i.e. decrease in sputtering resistance). This might result in a shorter product life of the PDP itself.

Some of conventional countermeasures for the above problems attempt to decrease the discharge voltage and reduce the electric power consumption by optimally maintaining secondary electron emission properties of the protective layer. The protective layer has properties of absorbing an impurity gas and therefore being easily deteriorated. The impurity gas includes organic impurities contained in the sealing material paste and others, such as various types of resin, solvating media, and the solvent, and the impurity gas, such as carbon dioxide and water vapor generated when the impurities are baked out in the pre-baking and the sealing steps (all of which are referred to below simply as "impurities"). Accordingly, an attempt has been made to maintain the secondary electron emission properties of the protective layer, by preventing the absorption of the impurity gas or by using a material which does not easily absorb the impurity gas in the protective layer.

Specifically, as disclosed in Patent Literatures 3 and 4, and Non-Patent Literature 3, a method for maintaining the secondary electron emission properties of the protective layer is proposed. In the method, the protective layer is made of a composite oxide film using alkaline rare earth metal oxides, such as SrO, CaO, and BaO, instead of MgO. Also, the discharge space is evacuated to high vacuum of approximately $1\times10^{-4}$ Pa before the discharge gas is introduced, in order to remove the impurities from the discharge space. According to the conventional method, steps from the protective layer formation step to the sealing step are performed throughout in one of a dried air atmosphere, a dried $N_2$ atmosphere, and a dried $O_2$ atmosphere. This effectively prevents the impurities, such as $H_2O$, from contaminating the protective layer.

Patent Literature 5 also discloses a method of forming the protective layer made of the composite oxide film using the alkaline rare earth metal oxides, such as SrO, CaO, and BaO, and performing the sealing and the evacuating steps throughout in vacuum for the purpose of preventing unwanted absorption or reaction between the protective layer and $H_2O$, CO, and $CO_2$ contained in the atmosphere and effectively evacuating the impurities contained in the discharge space.

CITATION LIST

Patent Literature

[Patent Literature 1]
Japanese Patent Application Publication No. 2003-131580
[Patent Literature 2]
Japanese Patent Application Publication No. 2005-157338
[Patent Literature 3]
Japanese Patent Application Publication No. 2002-231129
[Patent Literature 4]
Japanese Patent Application Publication No. 2007-265768
[Patent Literature 5]
Japanese Patent Application Publication No. 2007-119833

Non-Patent Literature

[Non-Patent Literature 1]
"NHK Giken R&D No. 103, May 2007, pp. 32-39."

SUMMARY OF INVENTION

Technical Problems

However, it still cannot be said that contamination of the protective layer by impurities can be effectively prevented with use of any of the above-described conventional techniques.

Specifically, it is difficult to completely remove the impurities attributed to a sealing material paste, even though the impurities are gasified as a result of being heated at a high temperature in pre-baking and sealing steps, and most of them are removed in an evacuating step. Furthermore, an earnest study of the present inventors revealed that heating the sealing material paste to a predetermined temperature or higher causes organic components attributed to the paste to polymerize, thereby generating tar. This adversely makes it even difficult to remove the impurities.

Meanwhile, a protective layer comprising a composite oxide film using alkaline rare earth metal as mentioned above has good secondary electron emission properties. However, at the present, a protective layer containing MgO tends to exhibit even better secondary electron emission properties. Accordingly, for the purpose of reducing electric power consumption, there is a demand for using, preferably, a MgO-based material as a material of the protective layer.

Thus, there still is room for improvement in the implementation of high-definition PDPs capable of exhibiting excellent image display performance with reduced electric power consumption.

The present invention has been conceived in view of the stated problems, and aims to provide a manufacturing method of plasma display panels that allows even high-definition PDPs to exhibit excellent image display performance while driving with a relatively low electric power consumption, by suppressing deterioration of the protective layer containing MgO due to absorption of the impurities.

Solution to Problem

In order to solve the above problems, one aspect of the present invention provides a manufacturing method for a plasma display panel that includes a front substrate and a back substrate, the front substrate having a MgO-containing protective layer on a main surface thereof, the manufacturing method comprising: a pre-baking step of pre-baking a paste containing a sealing material and a binder at a pre-baking temperature, a highest pre-baking temperature being set to be higher than or equal to a disappearance point of the binder and lower than a softening point of the sealing material, the paste having been applied along peripheral edges of one of the front and the back substrates; a positioning step of superposing, after the pre-baking step, one of the front and the back substrates on the other via the pre-baked paste so that the protective layer opposes a main surface of the back substrate with a gap therebetween; a sealing step of sealing, after the positioning step, the substrates together along the peripheral edges thereof to enclose an inner space between the substrates, by baking the substrates in a mixed gas atmosphere consisting essentially of a non-oxidizing gas and a reducing gas; and an evacuating step of evacuating the inner space after the sealing step.

Here, the pre-baking step may include: a first decreasing sub-step of decreasing a temperature of the substrate applied with the paste to a first temperature after pre-baking the paste at the highest pre-baking temperature, the first temperature being lower than the disappearance point of the binder and higher than a room temperature; and a second decreasing sub-step of decreasing, after the first decreasing sub-step, the temperature of the substrate applied with the paste from the first temperature to the room temperature.

In this case, the first temperature may be 200° C., and a time required for the first decreasing sub-step may fall in a range from 20 to 30 minutes inclusive.

Furthermore, a time required for the second decreasing sub-step may be at least five times longer than the time required for the first decreasing sub-step.

Furthermore, a $N_2$ gas or an Ar gas is preferably used as the non-oxidizing gas.

Furthermore, a $H_2$ gas is preferably used as the reducing gas.

Preferably, a partial pressure of the reducing gas contained in the mixed gas atmosphere (i.e. sealing atmosphere) falls in a range from 0.1% to 3% inclusive.

The highest pre-baking temperature may be at least 10° C. lower than the softening point.

Furthermore, the highest pre-baking temperature may be lower than the softening point by a difference of 10° C. to 50° C. inclusive.

Furthermore, in the pre-baking step, the sealing material contained in the paste may include low-melting glass, and the pre-baking temperature may be higher than or equal to a glass-transition point of the low-melting glass and at least 10° C. lower than the softening point of the low-melting glass.

In this case, the glass transition point may fall in a range from 336° C. to 365° C. inclusive.

It is also possible to set the softening point of the sealing material to be 410° C. to 450° C., and the sealing temperature to be 450° C. to 500° C.

The sealing material may contain one or more substances selected from the group consisting of cordierite, $Al_2O_3$, and $SiO_2$ as a filler.

Alternatively, the sealing material may contain bismuth oxide and cordierite.

Alternatively, the sealing material may contain lead oxide and cordierite.

In the sealing step, the sealing temperature may be at least 40° C. higher than the softening point.

The pre-baking step may be performed in a $N_2$ atmosphere with a dew point of −45° C. or lower.

The pre-baking step may be performed in a $N_2$ atmosphere containing $O_2$ at a partial pressure higher than 0% and lower than or equal to 1%.

In the pre-baking step, pre-baking at the highest pre-baking temperature may be maintained for a time of at least ten minutes and within fifty minutes.

The pre-baking step is preferably performed in an oxidizng atmosphere.

The sealing step may include: a sealing temperature increasing sub-step of increasing a temperature of the substrates from a room temperature to the sealing temperature; a sealing temperature maintaining sub-step of maintaining, after the sealing temperature increasing sub-step, the sealing temperature for a predetermined period of time; and a sealing temperature decreasing sub-step of decreasing, after the sealing temperature maintaining sub-step, the temperature of the substrates from the sealing temperature to a temperature lower than the softening point. The sealing temperature increasing sub-step, the sealing temperature maintaining sub-step, and the sealing temperature decreasing sub-step may be sequentially performed in the mixed gas atmosphere consisting essentially of the non-oxidizing gas mixed with the reducing gas, or more preferably, in the mixed gas atmosphere consisting essentially of the $N_2$ gas or the Ar gas, mixed with 0.1% to 3% of the $H_2$ gas.

The evacuating step may include: an evacuation temperature maintaining sub-step of maintaining a temperature of the substrates for a predetermined period of time at a temperature lower than or equal to a room temperature and lower than the softening point; and an evacuation temperature decreasing sub-step of decreasing, after the evacuation temperature maintaining sub-step, the temperature of the substrates to the room temperature. The evacuation temperature maintaining sub-step and the evacuation temperature decreasing sub-step may be sequentially performed in an atmosphere in a depressurized state.

Prior to the sealing step, barrier ribs may be installed on the main surface of the back substrate at pitches of 0.16 mm or less, and a phosphor layer may be formed between each of the barrier ribs, and after the evacuating step, a discharge gas containing Xe at a partial pressure of 15% or higher may be introduced into the inner space.

Furthermore, prior to the sealing step, barrier ribs may be installed on the main surface of the back substrate at pitches that have been determined so that the number of pixels is at least 1920 horizontally and at least 1080 vertically, and a phosphor layer may be formed between each of the barrier ribs, and after the evacuating step, a discharge gas containing Xe at a partial pressure of 15% or higher may be introduced into the inner space.

Another aspect of the present invention provides a driving method for a plasma display panel manufactured by the manufacturing method mentioned above, wherein the plasma display panel includes (i) display electrode pairs each composed of a scan electrode and a sustain electrode, (ii) data electrodes, and (iii) discharge cells each formed at intersections of the display electrode pairs and the data electrodes. The display electrode pairs are grouped into a plurality of display electrode pair groups. For each display electrode pair group, one field period includes a plurality of subfields, each subfield including a writing period in which writing discharge is generated in a corresponding one of the discharge cells and a sustain period in which sustain discharge is generated in the corresponding one of the discharge cells. In the driving of the plasma display panel, in each display electrode pair group, a time spent for a sustain period included in each subfield is $Tw\times(N-1)/N$ or less, where N denotes the number of the display electrode pair groups, Tw denotes a time required for performing a writing action once for each of all the discharge cell in the whole plasma display panel, N being an integer two or greater.

Advantageous Effects of Invention

In the manufacturing method for a plasma display panel according to the present invention, the highest temperature set for pre-baking in the pre-baking step (i.e. highest pre-baking temperature) is lower than the softening point of the sealing material. The temperature settings enable the organic components attributed to the paste of the sealing material to remain still as low molecular components between both the substrates even after the pre-baking step.

Furthermore, in the pre-baking step of the present invention, after one of the front substrate and the back substrate is pre-baked at the highest pre-baking temperature, a temperature of the pre-baked substrates is decreased to the room temperature in two decreasing sub-steps. In the first decreasing sub-step, compared with the subsequent second decreasing sub-step, the temperature of the pre-baked substrate is more rapidly lowered from the highest pre-baking temperature to the first temperature which is lower than the disappearance point of the binder and higher than the room temperature. This prevents the low molecular organic components included in the paste of the sealing material from being excessively dissolved upon exposure to the highest pre-baking temperature for a long period of time. As a result, the problem relating difficulty in removing the organic components excessively dissolved and incorporated in the sealing portion is avoided. Furthermore, by spending a longer time in the second decreasing sub-step than in the first decreasing sub-step, damage to the prebaked substrate caused by rapid cooling is prevented.

As mentioned above, the present invention allows the organic components attributed to the paste of the sealing material to optimally remain as the low molecular components between both the substrates. As a result, the organic components along with other impurities are effectively removed in the evacuating step. This reduces a risk that the organic components are polymerized into tar due to excessive heating, or remain in glass components of the sealing material even after manufacture of the PDP as a result of being excessively dissolved and incorporated in the sealing portion due to the high temperature.

Conventionally, the tar generated due to the organic components of the sealing material paste remains between the substrates, since the tar has a low vapor pressure and therefore is difficult to remove even in the evacuating step. For this reason, the tar causes deterioration of the MgO-containing protective layer, which might lead to an increase in the discharge voltage of the PDP. However, in the present invention, the generation of tar is suppressed and the organic components are effectively removed in the evacuating step as mentioned above. As a result, the present invention prevents deterioration of the protective layer of the PDP due to absorption of the impurities.

Furthermore, in the present invention, since the sealing step is performed in the non-oxidizing atmosphere or the reducing atmosphere, the organic components of the sealing material paste are prevented from polymerizing, and therefore optimally removed as the low molecular components. This also provides the effect of preventing deterioration of the protective layer. Furthermore, when the sealing step is performed in the reducing atmosphere, unwanted oxidization is prevented, and the crystalline structure is improved, whereby the secondary electron emission properties are improved.

As a result, the PDP of the present invention has excellent secondary electron emission properties, so that the PDP exhibits highly responsive image display performance while optimally reducing the firing voltage.

The present invention is highly effective when applied to high-definition and ultra-high-definition panels, or panels with a large-sized panel.

DESCRIPTION OF EMBODIMENT

The following describes a preferred embodiment of the present invention with reference to the drawings. Firstly, a description is given of a PDP having a high-definition cell structure and a driving method suitable for the PDP. Secondly, a description is given of a manufacturing method for a PDP in which absorption of impurities in a protective layer is suppressed. Of course, the present invention is not limited to the embodiment, and various changes may be made as necessary without departing from the technical scope of the present invention.

Embodiment

Structure of PDP Apparatus

A PDP apparatus 1000 according to the embodiment includes a PDP 1 which is connected to predetermined drive circuits 111 to 113.

Figure 1:
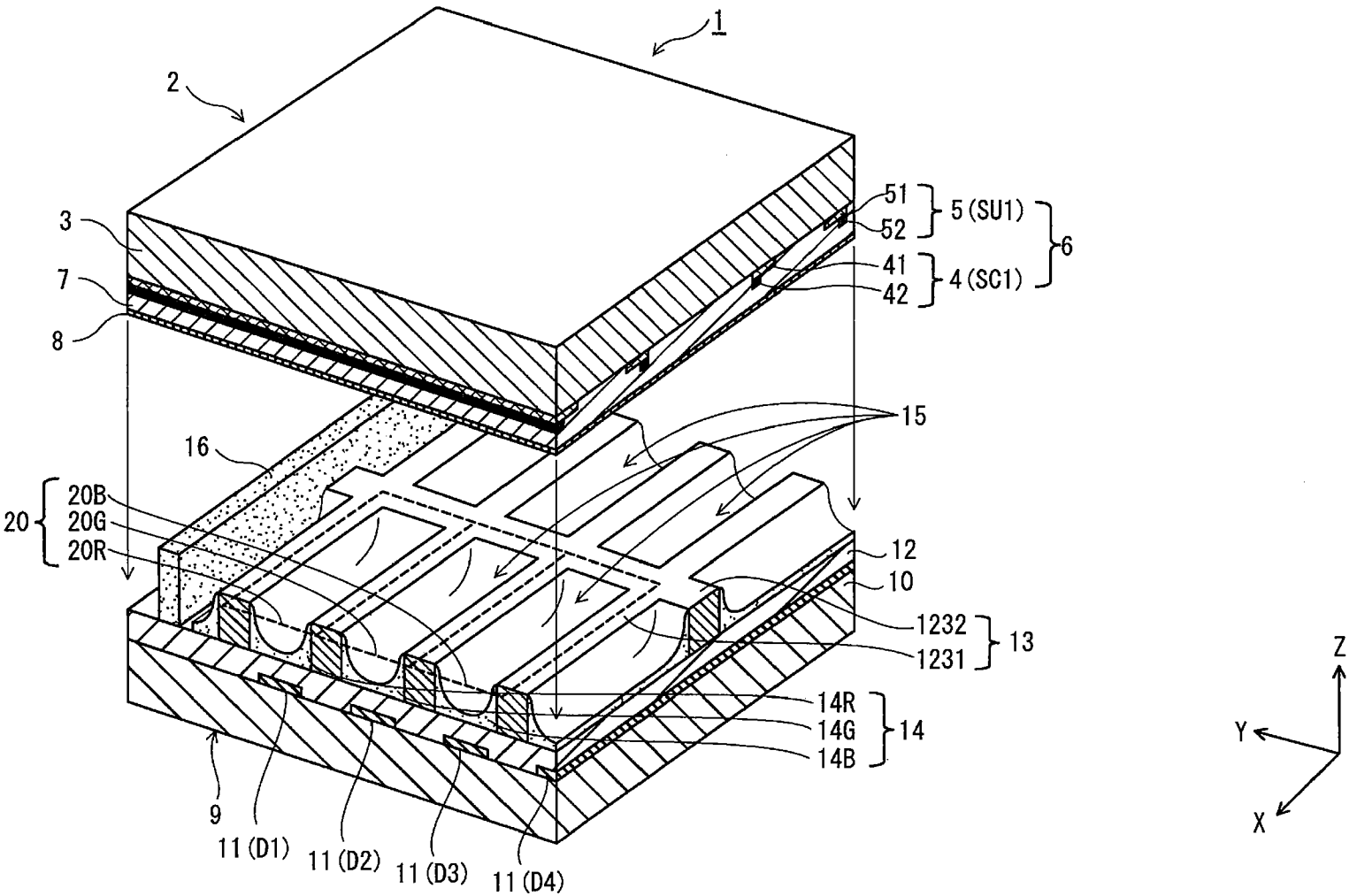
FIG. 1 is a perspective sectional view showing an overall structure of a PDP according to an embodiment.
Figure 2:
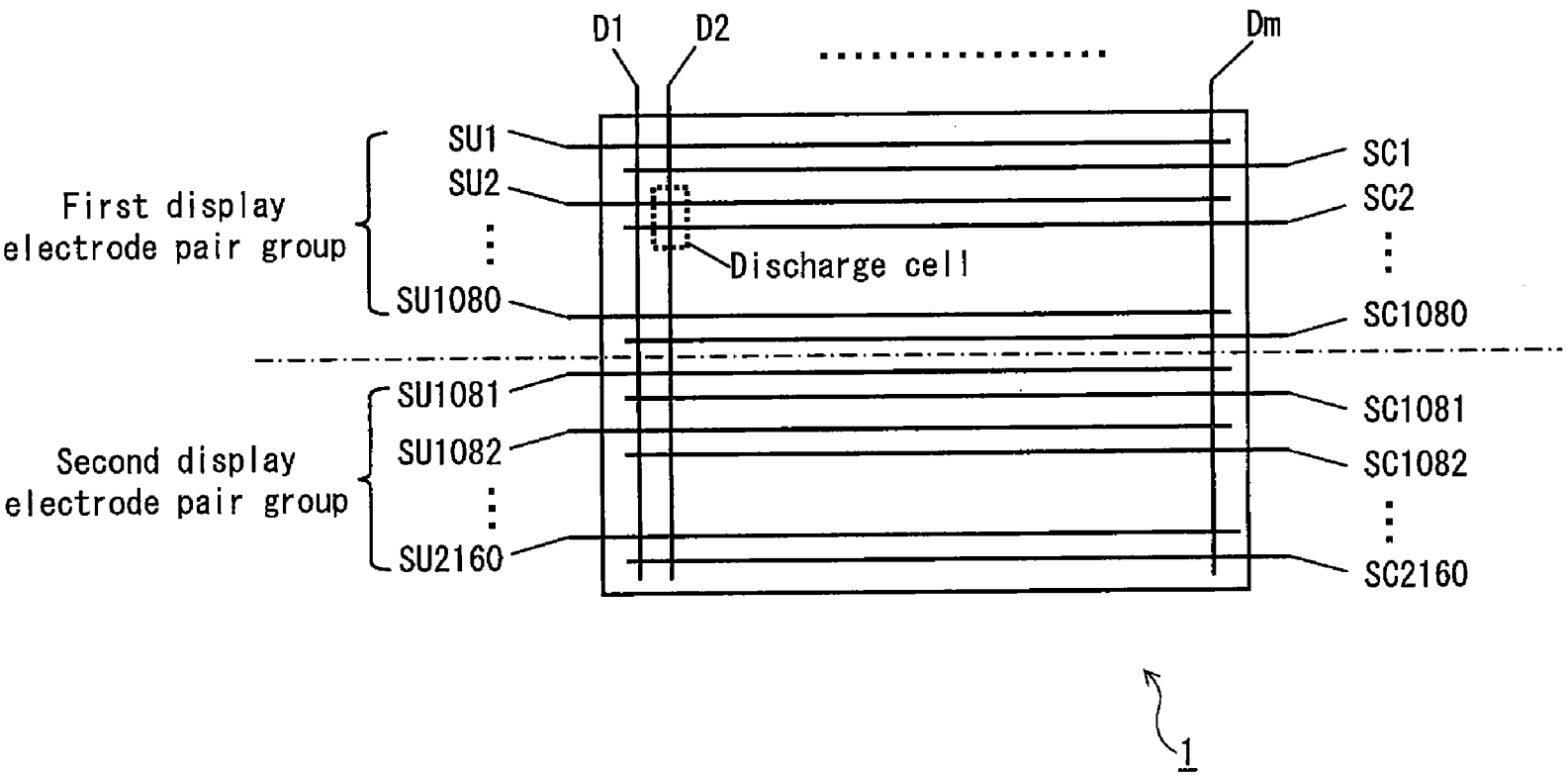
FIG. 2 is a view showing electrode layout in the PDP according to the embodiment.

FIG. 1 is a perspective sectional view of an overall structure of the PDP 1, and partially shows an area in the vicinity of a sealing portion provided along peripheral edges of the PDP 1. FIG. 2 schematically shows an overall structure of electrode layout in the PDP 1.

As shown in FIG. 1, the PDP 1 is mainly composed of a front substrate (front panel) 2 and a back substrate (back panel) 9 that are sealed together along the peripheral edges thereof by a sealing portion 16 in a manner such that the panels 2 and 9 are superposed with a main inner surface of the front panel 2 opposing a main inner surface of the back panel 9.

The front substrate 2 includes a front substrate glass 3 as its basis. On the main surface of the front substrate glass 3, a plurality of display electrode pairs 6 (each composed of a scan electrode 4 and a sustain electrode 5 of FIG. 1 which correspond to SC1 and SU1 of FIG. 2, respectively) are each disposed in a stripe pattern. In each display electrode pair 6, a predetermined discharge gap is provided.

The scan electrode 4 (sustain electrode 5) in electrode pair 6 is composed of a transparent electrode 51 (41) and a bus line 52 (42) layered thereon. The transparent electrodes 51 and 41 are disposed in a stripe pattern, and made of transparent conductive materials of metal oxide, such as indium tin oxide (ITO), zinc oxide (ZnO), and tin oxide ($SnO_2$). The bus lines 42 and 52 are made of an Ag thick film, an Al thin film, a Cr/Cu/Cr layered thin film, or the like. These bus lines 52 and 42 reduce the sheet resistance of the transparent electrodes 51 and 41. The display electrode pairs 6 may be made solely of metal materials, such as Ag. The pattern of the display electrode pairs 6 is not limited to stripe, and may be formed using a plurality of thin lines or a desired pattern.

On the entire main surface of the front substrate glass 3 where the display electrode pairs 6 are disposed, a dielectric layer 7 is formed with use of a screen printing method or other method. The dielectric layer 7 is made of low-melting glass (approximately 30 μm thick) that contains lead oxide (PbO), bismuth oxide ($Bi_2O_3$), phosphorus oxide ($PO_4$), or zinc oxide (ZnO) as the principal components. The dielectric layer 7 has a current limiting function that is unique to AC PDPs. This is one of the elements for achieving a longer life than DC PDPs.

A protective layer 8 is a thin film applied for the purpose of protecting the dielectric layer 7 from ion bombardment at the time of discharge and lowering the firing voltage. The protective layer 8 is formed with MgO material that has high sputtering resistance and a high secondary electron emission coefficient γ. The MgO material further has favorable optical transparency and electric insulation.

On the other hand, on a main surface of the back substrate glass 10 that is the substrate of the back substrate 9, data (address) electrodes 11 (of FIG. 1 which correspond to D1 to D4 of FIG. 2) are formed in a stripe pattern at regular intervals. The address electrodes 11 are adjacent to each other in the y direction, and each extends in the x direction. The address electrodes 11 are made up of any one of an Ag thick film, an Al thin film, a Cr/Cu/Cr layered thin film, or the like.

A dielectric layer 12 is disposed on the entire surface of the back substrate glass 9 to enclose the data electrodes 11. Meanwhile, the dielectric layer 12 has a structure similar to the dielectric layer 7. In order to make the dielectric layer 12 serve also as a visible light reflection layer, some particles that reflect visible light, such as $TiO_2$, may be dispersed and mixed in the glass materials.

On the dielectric layer 12, barrier ribs 13 (each composed of a pair of barrier rib portions 1231 and 1232) are further formed in a grip pattern so as to stand in the gap between the adjacent data electrodes 11, whereby the discharge cells are partitioned. The barrier ribs 13 prevent the occurrence of erroneous discharge or optical crosstalk between the adjacent discharge cells by the partitioning. The pitches of the barrier rib 13 are determined so that the number of discharge cells is at least 1920 horizontally and at least 1080 vertically.

The shape of the barrier ribs 13 is not limited to the grid pattern and may be stripe, honeycomb (including a case in which the panel has a large depth in the thickness direction), and other shapes.

On the lateral surfaces of two adjacent barrier ribs 13 and on the surface of the dielectric layer 12 between the lateral surfaces, a phosphor layer 14 (one of 14R, 14G, and 14B) corresponding to either red (R), green (G) or blue (B) color is formed for color display.

Note that the dielectric layer 12 is not essential and that the phosphor layer 14 may directly cover the data electrodes 11.

The front substrate 2 and the back substrate 9 are air-tightly bonded (i.e. sealed) along the peripheral edges of both the panels 2 and 9 by the sealing member 16 containing a predetermined sealing material such that the data electrodes 11 are orthogonal to the display electrode pairs 6 in the respective longitudinal directions. In a discharge space 15 enclosed by both the panels 2 and 9, a discharge gas that is composed of one or more inert gas components selected from the group consisting of He, Xe, Ne, or the like (e.g. an Ne—Xe-based gas containing 15% or higher by volume of Xe) is enclosed at a predetermined pressure.

Between two adjacent barrier ribs 13 is the discharge space 15. Where the adjacent display electrode pair 6 intersects a data electrode 11 via the discharge space 15 corresponds to a discharge cell (also referred to as a "sub-pixel") that contributes to display images. Three adjacent discharge cells whose colors are red, green and blue compose one pixel.

As shown in FIG. 2, in a direction of rows (i.e. Y direction of FIG. 1), n pieces of scan electrodes SC1 to SCn (i.e. scan electrodes 4 of FIG. 1) and n pieces of sustain electrodes SU1 to SUn (i.e. sustain electrodes 5 of FIG. 1) are arranged to extend. In a direction of columns (i.e. X direction of FIG. 1), m pieces of data electrodes D1 to Dm (i.e. data electrodes 11 of FIG. 1) are arranged to extend. In the PDP 1, a discharge cell (enclosed in a dotted line in FIG. 2) is formed at the intersection at which a pair of scan electrode SCi (i=1 to n) and sustain electrode Sui meets a data electrode Dj (j=1 to m), and a total of (m×n) discharge cells are formed in a matrix pattern. Although the number of pairs of display electrodes 6 formed in the PDP 1 is not particularly limited, the description is given of the case where n=2160 in the present embodiment.

The 2160 pairs of display electrodes 6 each composed of one of the scan electrodes SC 1 to SC 2160 and one of the sustain electrodes SU 1 to SU 2160 are grouped into a plurality of display electrode pair groups. Note that a method for determining the number of the display electrode pair groups N is described later below. In the present embodiment, the description is given of the case where a panel area is divided into an upper area and a lower area to form two display electrode pair groups (N=2). As shown in FIG. 2, the display electrode pairs positioned in the upper half of the panel area are grouped into a first display electrode pair group, and the display electrode pairs positioned in the lower half of the panel area are grouped into a second display electrode pair group. In other words, 1080 scan electrodes SC 1 to SC 1080 and 1080 sustain electrodes SU 1 to SU 1080 belong to the first display electrode pair group, and 1080 scan electrodes SC 1081 to SC 2160 and 1080 sustain electrodes SU 1081 to SU 2160 belong to the second display electrode pair group.

Figure 3:
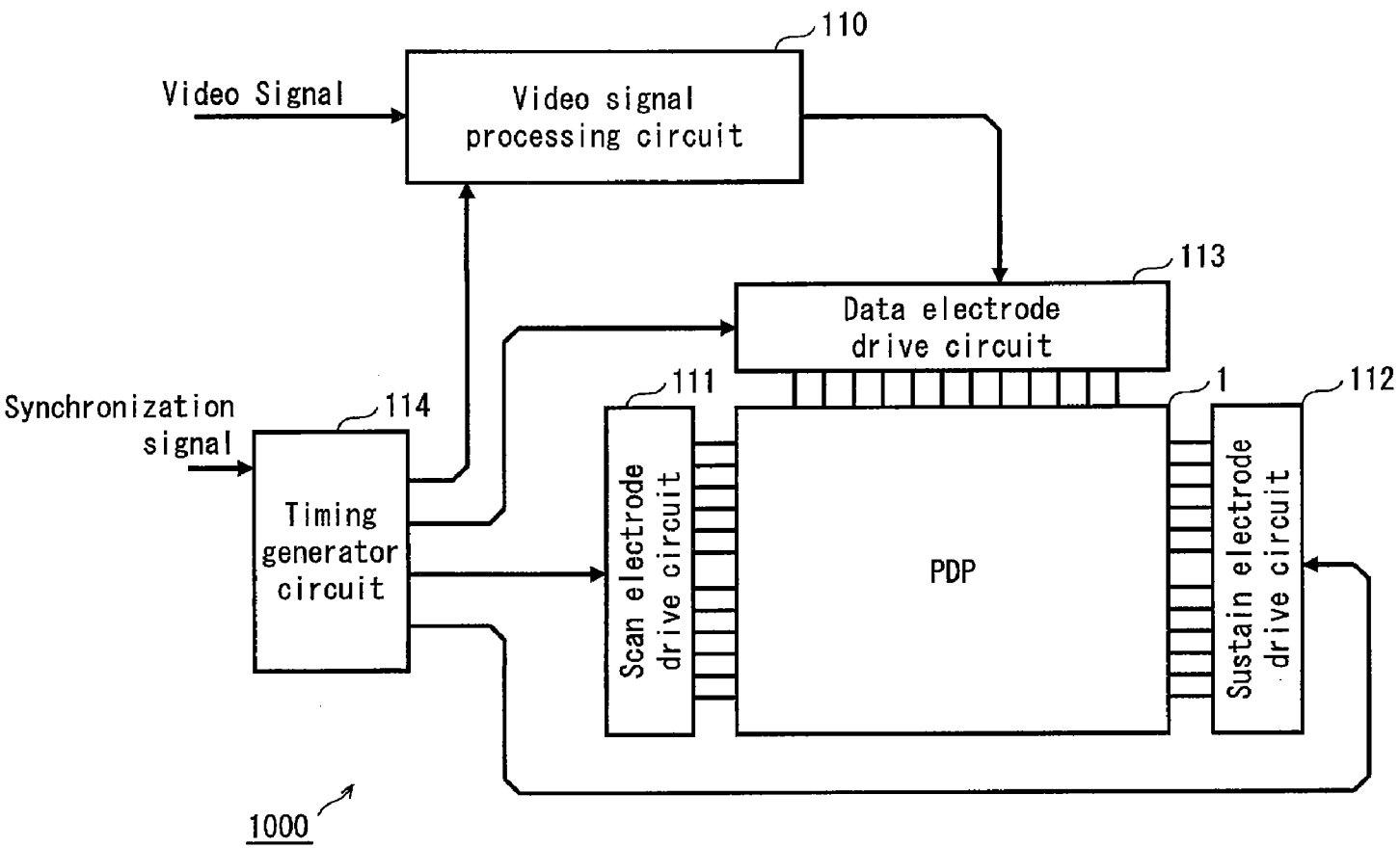
FIG. 3 is a circuit block diagram of the PDP apparatus according to the embodiment.

Next, FIG. 3 is a circuit block diagram of the PDP apparatus 1000. The PDP apparatus 1000 includes the above-described PDP 1, a video signal processing circuit 110, a data electrode drive circuit 113, a scan electrode drive circuit 111, a sustain electrode drive circuit 112, a timing generator circuit 114, and a power source circuit (not shown) for supplying necessary power to each circuit block. The scan electrodes SC 1 to SC 2160 are connected to the drive circuit 111, the sustain electrodes SU 1 to SU 2160 are connected to the drive circuit 112, and the data electrodes D1 to Dm are connected to the drive circuit 113.

The video signal processing circuit 110 converts a video signal input from the outside into video data indicating, for each subfield, light emission or no light emission.

The data electrode drive circuit 113 includes m pieces of switches for applying voltage Vd or voltage 0 (V) to each of the m pieces of data electrodes D1 to Dm. The data electrode drive circuit 113 also converts the image data output from the video signal processing circuit 110 into writing pulses corresponding to the data electrodes D1 to Dm, and apply the writing pulses to the data electrodes D1 to Dm.

The timing generator circuit 114 generates various timing signals for controlling operations of the respective circuits based on a horizontal synchronizing signal and a vertical synchronizing signal, and sends the generated timing signals to the respective circuits.

In response to a timing signal, the scan electrode drive circuit 111 drives the scan electrodes SC 1 to SC 1080 belonging to the first display electrode pair group and the scan electrodes SC 1081 to SC 2160 belonging to the second display electrode pair group.

In response to a timing signal, the sustain electrode drive circuit 112 drives the sustain electrodes SU 1 to SU 1080 belonging to the first display electrode pair group and the sustain electrodes SU 1081 to SU 2160 belonging to the second display electrode pair group.

Figure 4:
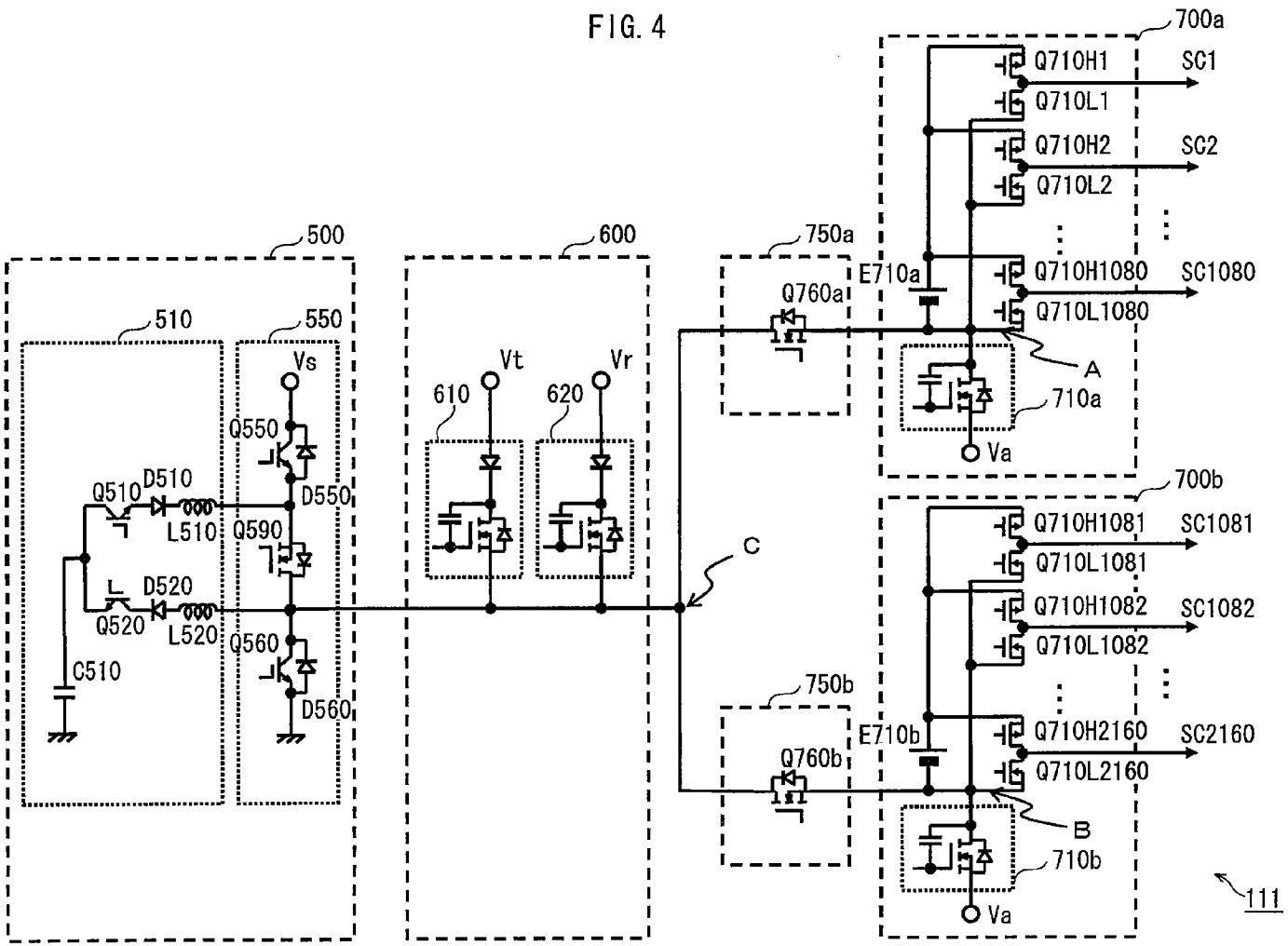
FIG. 4 is a circuit diagram of a scan electrode drive circuit in the PDP apparatus according to the embodiment.

Next, FIG. 4 is a circuit diagram of the scan electrode drive circuit 111. The scan electrode drive circuit 111 includes a sustain pulse generator circuit 500 of the scan electrode side (abbreviated below simply as the "sustain pulse generator circuit 500"), a ramp generator circuit 600, a scan pulse generator circuit 700*a*, a scan pulse generator circuit 700*b*, a switch circuit 750*a* of the scan electrode side (abbreviated below simply as the "switch circuit 750*a*"), and a switch circuit 750*b* of the scan electrode side (abbreviated below simply as the "switch circuit 750*b*").

The sustain pulse generator circuit 500 includes an electric power recovery unit 510 and a voltage clamp unit 550, and generates sustain pulses to be applied to the scan electrodes SC 1 to SC 1080 belonging to the first display electrode pair group or the scan electrodes SC 1081 to SC 2160 belonging to the second display electrode pair group.

The electric power recovery unit 510 includes a capacitor C510 for recovering electric power, switching devices Q510 and Q520, diodes D510 and D520 for preventing a back current, and resonance inductors L510 and L520. The electric power recovery unit 510 causes an LC resonance between inter-electrode capacitance of each display electrode pair and the inductor L510 or the inductor L520 in order to apply a sustain pulse having a rising waveform or a falling waveform. At a rising edge of the sustain pulse, charges accumulated in the capacitor C510 provided for electric power recovery are transferred to the inter-electrode capacitance via the switching device Q510, the diode D510, and the inductor L510. At a falling edge of the sustain pulse, the charges accumulated in the inter-electrode capacitance are returned to the capacitor C510 for electric power recovery via the inductor L520, the diode D520, and the switching device Q520. In this way, the electric power recovery unit 510 applies a sustain pulse having the rising waveform or the falling waveform using the LC resonance, without a need for an electric power supply from the power source. As a result, electric power consumption in the power recovery unit 510 is ideally "zero". Meanwhile, the capacitor C510 provided for electric power recovery has a capacity larger enough compared with the inter-electrode capacitance, and is charged at approximately Vs/2 which is half of the voltage Vs so that the capacitor C510 functions as the power source of the power recovery unit 510.

The voltage clamp unit 550 includes switching devices Q550 and Q560. By turning the switching device Q550 on, output voltage from the sustain pulse generator circuit 500 (i.e. a voltage level at a node C of FIG. 4) is clamped to the voltage Vs. By turning the switching device Q560 on, output voltage from the sustain pulse generator circuit 500 is clamped to the voltage 0 (V). This allows a stable flow of a large discharge current utilizing the sustain discharge, while reducing impedance during voltage application from the voltage clamp unit 550.

Thus, the sustain pulse generator circuit 500 generates a sustain pulse by controlling the switching devices Q510, Q520, Q550, and Q560. These switching devices may be made with use of a MOSFET, an IGBT, and the like which are publicly known. In the circuit shown in FIG. 4, IGBTs are utilized as the switching devices. When the IGBTs are used as the switching devices Q550 and Q560, it is necessary to secure a current path extending in an opposite direction to the current that is controlled. Accordingly, as shown in FIG. 4, the diode D550 is connected in parallel with the switching device Q550, and the diode D560 is connected in parallel with the switching device Q560. Although not shown in FIG. 4, a diode may be connected in parallel with each of the switching device Q510 and the switching device Q520 for the purpose of protection of the IGBTs.

A switching device Q590 is a separation switch provided for preventing a current from flowing back from the ramp generator circuit 600 which is described later below towards the voltage Vs via the diode D550 when the voltage level at the node C is increased to, for example, Vi2 which is higher than Vs in an initialization period.

The ramp generator circuit 600 includes two mirror integration circuits 610 and 620. The mirror integration circuit 610 causes the output voltage from the ramp generator circuit 600 (i.e. a voltage level at a node C of FIG. 4) to increase with a gentle slope to voltage Vt. The mirror integration circuit 620 causes the output voltage from the ramp generator circuit 600 to increase with a gentle slope to voltage Vr.

The scan pulse generator circuit 700*a* includes a power source E710*a* of voltage Vp, a mirror integration circuit 710*a*, switching devices Q710H1 to Q710H1080, and switching devices Q710L1 to Q710L1080. The mirror integration circuit 710*a* causes a lower-side voltage of the power source E710*a* (i.e. a voltage level at a node A of FIG. 4) to decrease with a gentle slope to voltage Va. The mirror integration circuit 710*a* also clamps the lower-side voltage of the power source E710*a* to the voltage Va. Each of the switching devices Q710L1 to Q710L1080 applies the lower-side voltage of the power source E710*a* to a corresponding one of the scan electrodes, and each of the switching devices Q710H1 to Q710H1080 applies a higher-side voltage of the power source E710*a* to a corresponding one of the scan electrodes.

The scan pulse generator circuit 700*b* has a similar configuration to the scan pulse generator circuit 700*a*, and includes a power source E710*b* of the voltage Vp, a mirror integration circuit 710*b*, switching devices Q710H1081 to Q710H2160, and switching devices Q710L1081 to Q710L2160. The scan pulse generator circuit 700*b* also applies a higher-side voltage or a lower-side voltage of the power source E710*b* to the scan electrodes SC1081 to SC2160 belonging to the second display electrode pair group.

The switch circuit 750*a* includes a switching device Q760*a*, and electrically connects or separates the sustain pulse generator circuit 500 and the ramp generator circuit 600 to/from the scan pulse generator circuit 700*a*. The switch circuit 750*a* includes a switching device Q760*b*, and electrically connects or separates the sustain pulse generator circuit 500 and the ramp generator circuit 600 to/from the scan pulse generator circuit 700*b*.

Figure 10:
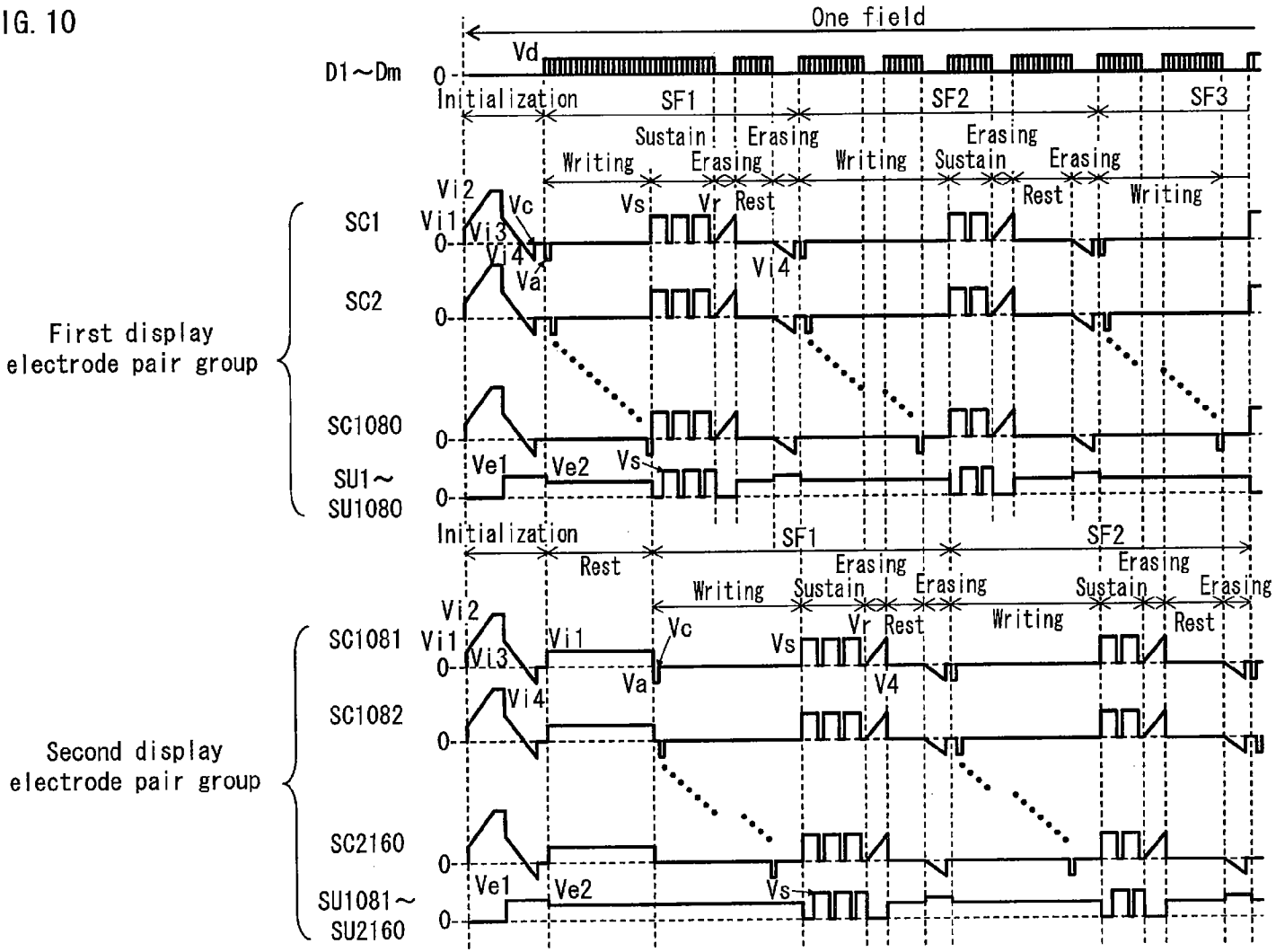
FIG. 10 is a view showing a waveform of a drive voltage applied to each electrode included in the PDP of the PDP apparatus according to the embodiment.

Using the above-described scan electrode drive circuit 111 allows application of drive waveforms which are shown in FIG. 10 and described later, to the scan electrodes SC1 to SC1080 belonging to the first display electrode pair group and the scan electrodes SC 1081 to SC 2160 belonging to the second display electrode pair group.

The following describes operations of the circuit 111 in details.

In the initialization period, the switching device Q760*a* included in the switch circuit 750*a* and the switching device Q760*b* included in the switch circuit 750*b* are on, the switching devices Q710H1 to Q710H2160 included in the scan pulse generator circuits 700*a* and 700*b* are on, and the switching devices Q710L1 to Q710L2160 included in the scan pulse generator circuits 700*a* and 700*b* are off. This allows simultaneous application of voltage obtained by adding the voltage Vp to an output from the ramp generator circuit 600, to the scan electrodes SC1 to SC2160. Subsequently, the switching device Q760*a* included in the switch circuit 750*a* and the switching device Q760*b* included in the switch circuit 750*b* are turned off, the switching devices Q710H1 to Q710H2160 included in the scan pulse generator circuits 700*a* and 700*b* are turned off, and the switching devices Q710L1 to Q710L2160 included in the scan pulse generator circuits 700*a* and 700*b* are turned on. Then, the mirror integration circuits 710*a* and 710*b* are turned on. The above allows simultaneous application of ramp voltage falling smoothly to voltage Vi4, to the scan electrodes SC1 to SC2160. Subsequently, the switching devices Q710L1 to Q710L2160 are turned off, and the switching devices Q710H1 to Q710H2160 are turned on. This allows simultaneous application of voltage Vc to the scan electrodes SC1 to SC2160.

During a writing period of the first display electrode pair group, the switching device Q760*a* included in the switch circuit 750*a* is off, and the mirror integration circuit 710*a* is on, and at the same time, each of switching devices Q710Hn and Q710Ln is turned on and off. This enables each of the switching devices Q710Hn and Q710Ln to apply a scan pulse to a corresponding one of scan electrodes SCn. The above method is also applied to a writing period of the second display electrode pair group, and application of a scan pulse to a corresponding one of the scan electrodes SCn is thus allowed.

During a sustain period of the first display electrode pair group, the switching device Q760*a* included in the switch circuit 750*a* is on, the switching device Q710H1 to Q710H1080 included in the scan pulse generator circuit 700*a* are off, and the switching devices Q710L1 to Q710L1080 included in the scan pulse generator circuit 700*a* are off. This allows application of an output from the sustain pulse generator circuit 500 to the first display electrode pair group, namely the switching devices SC1 to SC1080. During the sustain period of the first display electrode pair group, the second display electrode pair group is in a writing period. Accordingly, the switching device Q760*b* included in the switch circuit 750*b* is off, and therefore an output from the sustain pulse generator circuit 500 does not affect the scan electrodes SC1081 to SC2160 belonging to the second display electrode pair group at all. This means that the above-described writing action can be performed independently of an output from the sustain pulse generator circuit 500, with respect to the scan electrodes SC1081 to SC2160 belonging to the second display electrode pair group.

Similarly, when the second display electrode pair group is in a sustain period and the first display electrode pair group is in a writing period, the switching device Q760*a* included in the switch circuit 750*a* is off, and therefore an output from the sustain pulse generator circuit 500 does not affect the scan electrodes SC1 to SC1080 belonging to the first display electrode pair group at all.

During the subsequent first half of an erasing period of the first display electrode pair group, the switching device Q760*a* included in the switch circuit 750*a* is on, the switching devices Q710H1 to Q710H1080 included in the scan pulse generator circuit 700*a* are off, and the switching devices Q710L1 to Q710L1080 included in the scan pulse generator circuit 700*a* are on. This allows application of an output from the ramp generator circuit 600 to the scan electrodes SC1 to SC1080.

During the first half of the erasing period of the first display electrode pair group, the second display electrode pair group is in a writing period (more accurately speaking, the writing action is interrupted), and the switching device Q760*b* included in the switch circuit 750*b* is off. Accordingly, output voltage from the ramp generator circuit 600 does not affect the scan electrodes SC1081 to SC2160 belonging to the second display electrode pair group at all.

The same applies to the subsequent rest period and the latter half of the erasing period. Since the switching device Q760*b* is off, output voltage from the ramp generator circuit 600 does not affect the scan electrodes SC1081 to SC2160 belonging to the second display electrode pair group at all.

As mentioned above, by turning off the switch circuits 750*a* and 750*b* during the periods when falling ramp voltage is applied and in the writing period, the scan electrode drive circuit 111 is enabled to apply a desired voltage to one of the display electrode pair groups without being affected by voltage applied in the other display electrode pair group.

Figure 5:
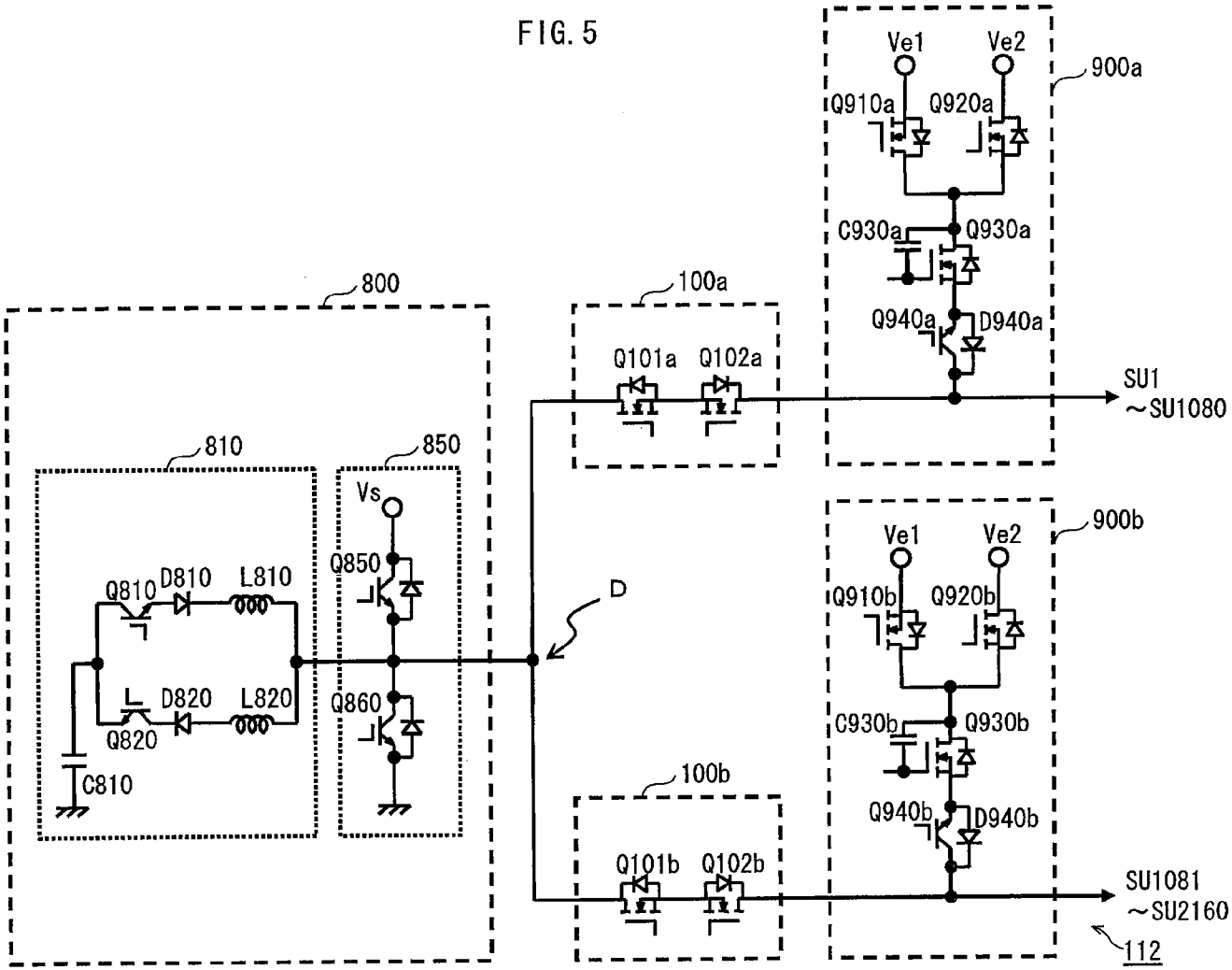
FIG. 5 is a circuit block diagram of a sustain electrode drive circuit in the PDP according to the embodiment.

Next, FIG. 5 is a circuit diagram of the sustain electrode drive circuit 112. The sustain electrode drive circuit 112 includes a sustain pulse generator circuit 800 of the sustain electrode side (abbreviated below simply as the "sustain pulse generator circuit 800"), a fixed voltage generator circuit 900*a*, a fixed voltage generator circuit 900*b*, a switch circuit 100*a* of the sustain electrode side (abbreviated below simply as the "switch circuit 100*a*"), and a switch circuit 100*b* of the sustain electrode side (abbreviated below simply as the "switch circuit 100*b*").

The sustain pulse generator circuit 800 includes a power recovery unit 810 and a voltage clamp unit 850, and generates sustain pulses to be applied to the sustain electrodes SU 1 to SU 1080 belonging to the first display electrode pair group or the sustain electrodes SU 1081 to SU 2160 belonging to the second display electrode pair group.

The power recovery unit 810 includes a capacitor C810 for recovering electric power, switching devices Q810 and Q820, diodes D810 and D820 for preventing the back current, and resonance inductors L810 and L820. Like the electric power recovery unit 510, the power recovery unit 810 causes the LC resonance between inter-electrode capacitance of each display electrode pair and the inductor L810 or the inductor L820, in order to apply a sustain pulse having a rising waveform or a falling waveform.

The voltage clamp unit 850 includes switching devices Q850 and Q860, and like the voltage clamp unit 550, clamps an output voltage from the sustain pulse generator circuit 800 (i.e. a voltage level at a node D of FIG. 5) to the voltage Vs or the voltage 0 (V).

The fixed voltage generator circuit 900*a* includes switching devices Q910*a*, Q920*a*, Q930*a*, and Q940*a*. The switching device Q930*a* and the switching device Q940*a* are connected in series to form a bi-directional switch so that the devices Q930*a* and Q940*a* control currents flowing in opposite directions. To the sustain electrodes SU 1 to SU 1080 belonging to the first display electrode pair group, a fixed voltage Ve1 is applied via the switching devices Q910*a*, Q930*a*, and Q940*a*, and a fixed voltage Ve2 is applied via the switching devices Q920*a*, Q930*a*, and Q940*a*.

The fixed voltage generator circuit 900*b* has a similar structure to the fixed voltage generator circuit 900*a*, and includes switching devices Q910*b*, Q920*b*, Q930*b*, and Q940*b*. The fixed voltage generator circuit 900*b* applies the fixed voltage Ve1 or the fixed voltage Ve2 to the sustain electrodes SU 1081 to SU 2160 belonging to the second display electrode pair group.

These switching devices may also be made with use of the MOSFET, the IGBT, and the like which are publicly known. In the circuit shown in FIG. 5, the MOSFET and the IGBT are utilized as the switching devices. The IGBTs are used as the switching devices Q940*a* and Q940*b*. In order to secure a current path extending in an opposite direction to a current that is controlled, a diode D940*a* is connected in parallel with the switching device Q940*a*, and a diode D940*b* is connected in parallel with the switching device Q940*b*.

Meanwhile, the switching device Q940*a* is provided for supplying a current in a direction from the sustain electrodes SU1 to SU1080 towards the power source of voltages Ve1 and Ve2. The switching device Q940*a* may be omitted in a case where a current is supplied only from the power source of voltages Ve1 and Ve2 towards the sustain electrodes SU1 to SU1080. The same applies to the switching device Q940*b*.

Furthermore, a capacitor C930*a* is connected between a gate and a drain of the switching device Q930*a*, and a capacitor C930*b* is connected between a gate and a drain of the switching device Q930*b*. The capacitors C930*a* and C930*b* are provided merely for smoothing a rising edge of a voltage waveform at the time of application of voltages Ve1 and Ve2, and not indispensable. In particular, when voltages Ve1 and Ve2 are varied step by step, the capacitors C930*a* and C930*b* are not required.

The switching device Q100*a* includes switching devices Q101*a* and Q102*a* that are connected in series to form a bi-directional switch so that the devices Q101*a* and Q102*a* control currents flowing in opposite directions. The switching device Q100*a* electrically connects or separates the sustain pulse generator circuit 800 to/from the sustain electrodes SU1 to SU1080 belonging to the first display electrode pair group.

The switching device Q100*b* includes switching devices Q101*b* and Q102*b* that are connected in series to form a bi-directional switch so that the devices Q101*b* and Q102*b* control currents flowing in opposite directions. The switching device Q200*b* electrically connects or separates the sustain pulse generator circuit 800 to/from the sustain electrodes SU1081 to SU2160 belonging to the second display electrode pair group.

Using the above-described sustain electrode drive circuit 112 allows application of the drive waveforms which are shown in FIG. 10 and described later, to the sustain electrodes SU1 to SU1080 belonging to the first display electrode pair group and the sustain electrodes SU1081 to SU2160 belonging to the second display electrode pair group. The following describes operations of the circuit 112 in details.

When the rising ramp waveform is applied to the scan electrodes SC1 to SC2160 in the initialization period, the switching devices Q101*a* and Q102*a* included in the switch circuits 100*a* are on, the switching devices Q101*b* and Q102*b* included in the switch circuit 100*b* are on, and an output from the sustain pulse generator circuit 800 is set to 0 (V). This allows simultaneous application of the voltage 0 (V) to the sustain electrodes SU1 to SU2160. During the latter half of the initialization period when the falling ramp waveform is applied to the scan electrodes SC1 to SC2160, the switching devices Q101*a*, Q101*b*, Q102*a*, and Q102*b* included in the switch circuits 100*a* and 100*b* are off, and the switching devices Q910*a*, Q910*b*, Q930*a*, Q930*b*, Q940*a*, and Q940*b* included in the fixed voltage generator circuit 900*a* and 900*b* are on. This allows simultaneous application of the voltage Ve1 to the sustain electrodes SU1 to SU2160.

In the writing period, the switching devices Q910*a* and Q910*b* are off, and the switching devices Q920*a* and Q920*b* are on. This allows output of the voltage Ve2.

During the sustain period of the first display electrode pair group, the switching devices Q101*a* and Q102*a* included in the switch circuit 100*a* are on, and the switching devices Q930*a* and Q940*a* included in the fixed voltage generator circuit 900*a* are off. This allows application of the sustain pulse output from the sustain pulse generator circuit 800 to the sustain electrodes SU1 to SU1080. During the sustain period of the first display electrode pair group, the second display electrode pair group is in the writing period. However, the switching devices Q101*b* and Q102*b* included in the switch circuit 100*b* are off, and therefore an output from the sustain pulse generator circuit 800 does not affect the scan electrodes SC1081 to SC2160 at all. The same applies to when the second display electrode pair group is in a sustain period and the first display electrode pair group is in a writing period, too. In other words, the switching devices Q101*b* and Q102*b* included in the switch circuit 100*b* are on, and the switching devices Q930*b* and Q940*b* included in the fixed voltage generator circuit 900*b* are off. This allows application of a sustain pulse output from the sustain pulse generator circuit 800, to the sustain electrodes SU1081 to SU2160. During the sustain period of the second display electrode pair group, the first display electrode pair group is in a writing period. However, the switching devices Q101*a* and Q102*a* included in the switch circuit 100*a* are off, and therefore an output from the sustain pulse generator circuit 800 does not affect the scan electrodes SC1 to SC1080 at all.

During the subsequent erasing period of the sustain electrodes SU1 to SU1080 belonging to the first display electrode pair group, the voltage 0 (V) is output from the sustain pulse generator circuit 800. During the following rest period, the switching devices Q101*a* and Q102*a* included in the switch circuit 100*a* are turned off, and the switching devices Q910*a*, Q930*a*, and Q940*a* included in the fixed voltage 900*a* are turned on. This allows application of the voltage Ve1 to the sustain electrodes SU1 to SU1080.

During the following latter half of the erasing period, the switching device Q910*a* included in the fixed voltage generator circuit 900*a* is turned off, and the switching device Q920*a* included in the fixed voltage generator circuit 900*a* is turned on. This allows application of the voltage Vet to the sustain electrodes SU1 to SU1080. During the above-mentioned first half of the erasing period, the rest period, and the latter half of the erasing period also, the sustain electrodes SU1081 to SU2160 belonging to the second display electrode pair group are not affected at all.

Similarly, when the sustain electrodes SU1081 to SU2160 belonging to the second display electrode pair group are in an erasing period and a rest period, and the sustain electrodes SU1 to SU1080 belonging to the first display electrode pair group are in a writing period, voltage applied to the sustain electrodes SU1081 to SU2160 does not affect the sustain electrodes SU1 to SU1080 at all.

As mentioned above, by turning off the switch circuits 100*a* and 100*b* during a writing period, the sustain electrode drive circuit 112 is enabled to apply a desired voltage to one of the display electrode pair groups without being affected by an applied voltage in the other display electrode pair group.

(Other Circuit Configurations)

The above sustain pulse generator circuit, the ramp generator circuit, and others in the present embodiment are described as merely a specific example. Any other circuit configurations may be adopted as far as the similar drive voltage waveform can be generated.

For example, the power recovery unit 510 shown in FIG. 4 is configured to, at a rising edge of the sustain pulse, transfer the charge accumulated in the capacitor C510 to the inter-electrode capacitance via the switching device Q510, the diode D510, the inductor L510, and the switching device Q520, and at a falling edge of the sustain pulse, return the charge accumulated in the inter-electrode capacitance to the capacitor C510 via the inductor L520, the diode D520, and the switching device Q520. However, the inductor L510 may be connected at one terminal to the node C, instead of a source of the switching device Q590. In this circuit configuration, at a rising edge of the sustain pulse, the charge accumulated in the capacitor C510 is transferred to the inter-electrode capacitance via the switching device Q510, the diode D510, and the inductor L510. Alternatively, only one inductor may double as the inductor L510 and the inductor L520.

Furthermore, although the ramp generator circuit 600 shown in FIG. 4 includes two mirror integration circuits 610 and 620, the circuit 600 may include one voltage switch circuit and one mirror integration circuit.

Furthermore, the capacitor C510 included in the power recovery unit 510 shown in FIG. 4, and the whole power recovery unit 810 shown in FIG. 5 may be omitted. In this case, the node D of FIG. 5 is connected to connection points of the switching devices Q510 and Q520 of FIG. 4.

Furthermore, the whole power recovery unit 510 shown in FIG. 4, and the capacitor C810 included in the power recovery unit 810 shown in FIG. 5 may be omitted. In this case, the node C is connected to connection points of the switching devices Q810 and Q820 of FIG. 5.

(Other Display Electrode Groups)

Although the description is given of the PDP 1 with a total of 2160 display electrode pairs 6 that are grouped into two display electrode pair groups as an example on the above, the present invention is not limited to the grouping method. For example, as shown in PDP 101 of FIG. 6, the number of the display electrode pairs may be 4320. In this panel configuration, the data electrodes D1 to Dm may be configured to intersect with the scan electrodes SC1 to SC2160 and sustain electrodes the SU1 to SU2160. Other data electrodes Dm+1 to D2*m* may also be configured to intersect with scan electrodes SC2161 to SC4320 and sustain electrodes SU2161 to SU4320. The above configuration of the PDP 101 also realizes the operations similar to the PDP 1 described above.

Specifically, pairs of the display electrodes composed of the scan electrodes SC1 to SC1080 and the sustain electrodes SU1 to SU1080, and pairs of display electrodes composed of the scan electrodes SC2161 to SC3240 and the sustain electrodes SU2161 to SU3240 may be made to belong to the first display electrode pair group. Also, display electrodes composed of the scan electrodes SC1081 to SC2160 and the sustain electrodes SU1081 to SU2160, and display electrodes composed of the scan electrodes SC3241 to SC4320 and the sustain electrodes SU3241 to SU4320 may be made to belong to the second display electrode pair group. The data electrodes D1 to Dm intersect only with the display electrode pairs composed of the scan electrodes SC1 to SC2160 and the sustain electrodes SU1 to SU2160, and cannot be affected by any operation performed by the scan electrodes SC2161 to SC4320 and the sustain electrodes SU2161 to SU4320 at all. Similarly, the data electrodes Dm+1 to D2*m* cannot be affected by the scan electrodes SC1 to SC2160 and the sustain electrodes SU1 to SU2160 at all.

Figure 6:
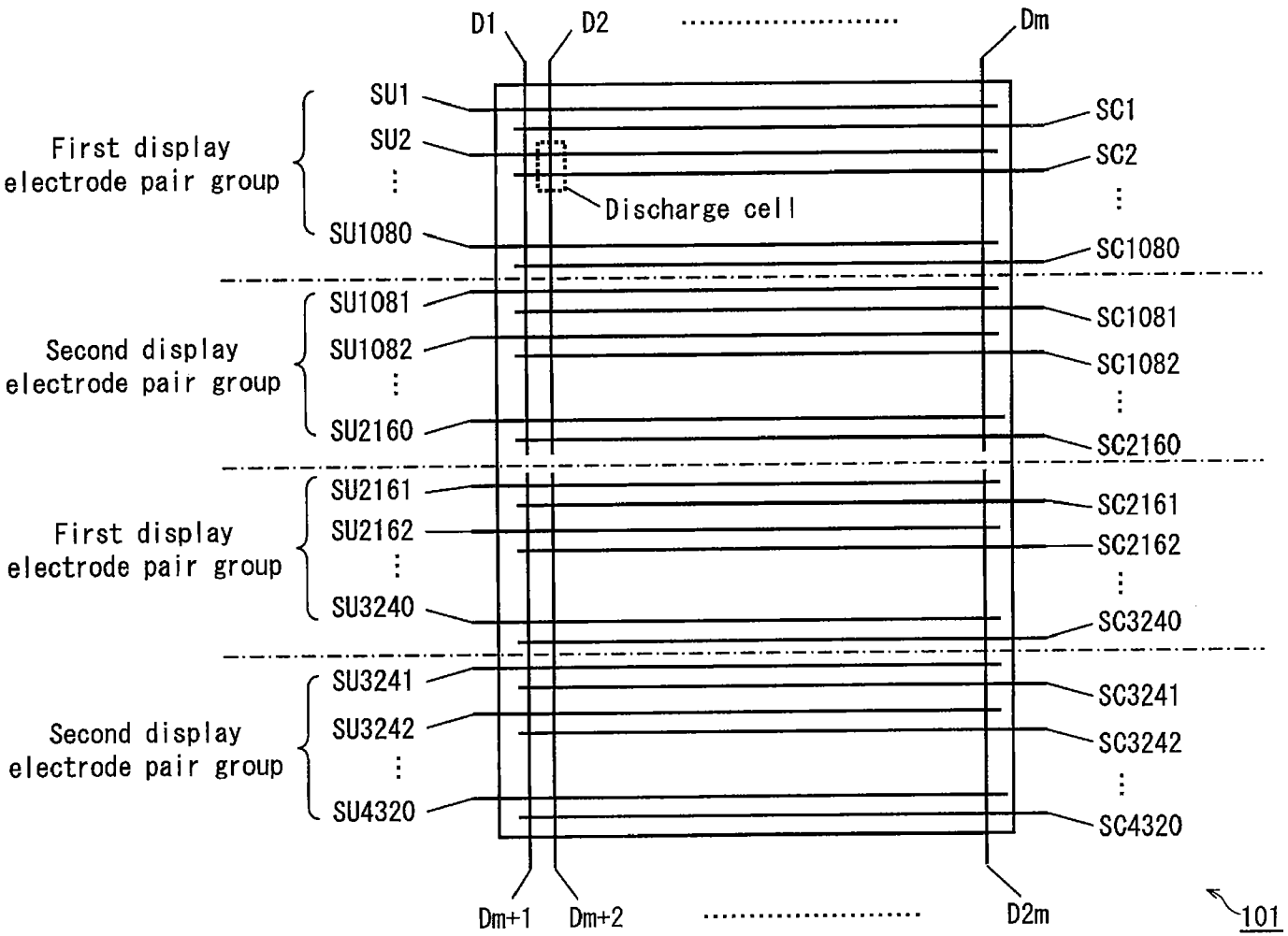
FIG. 6 is a view showing another electrode layout in the PDP apparatus according to the embodiment.

It can therefore be said that the PDP 101 shown in FIG. 6 has upper and lower areas which operate independently from each other. Even when the number of the display electrode pairs is doubled, the similar operations are performed as far as the data electrodes are grouped into upper and lower groups in the panel.

Figure 7:
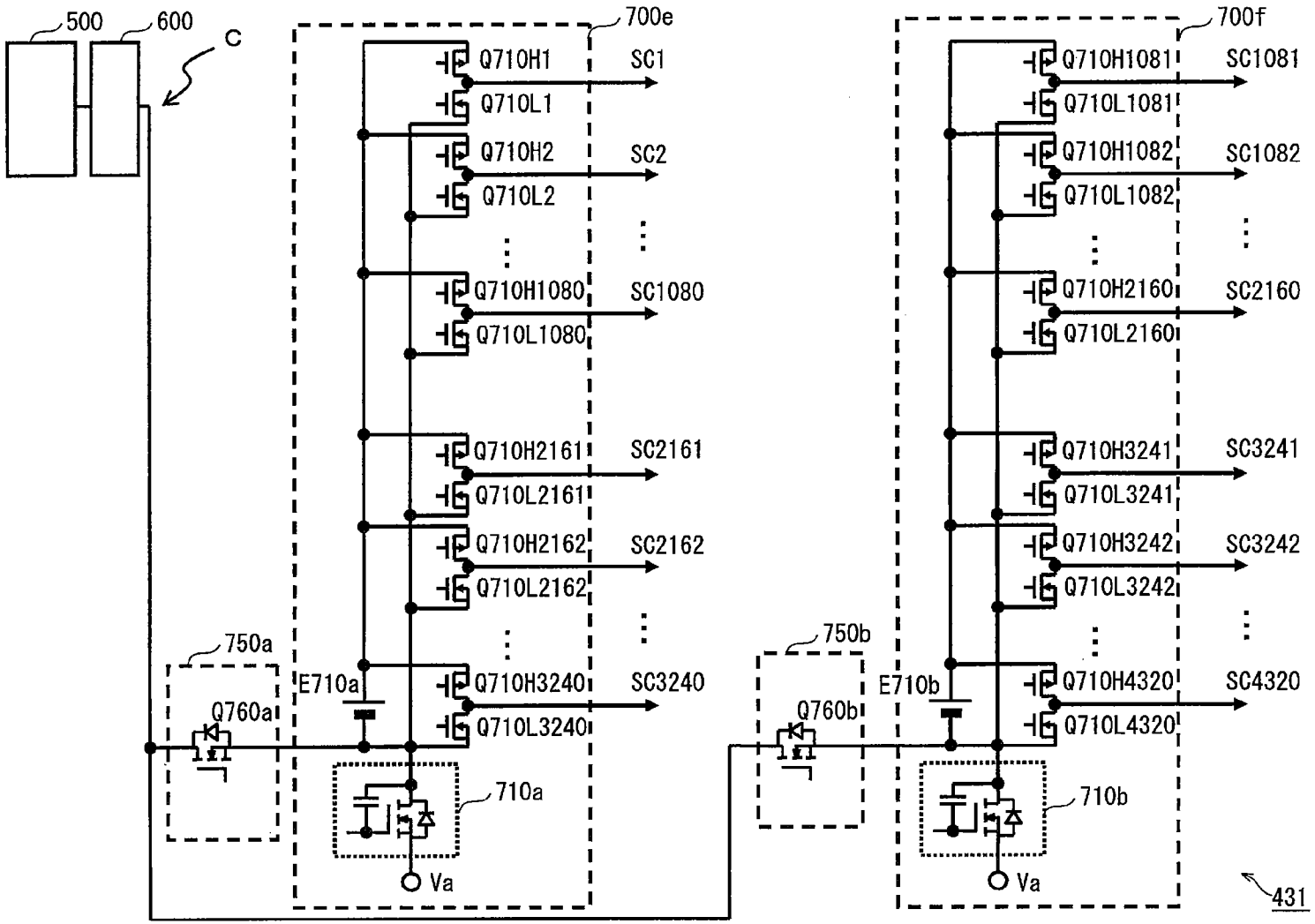
FIG. 7 is a circuit diagram of another scan electrode drive circuit in the PDP apparatus according to the embodiment.

FIG. 7 is a circuit diagram of a scan electrode drive circuit 431 for driving the scan electrodes included in the PDP 101 of FIG. 6. The scan electrode drive circuit 431 differs from the scan electrode drive circuit 111 in the following two points. One is that, compared with the scan pulse generator circuit 700*a*, a scan pulse generator circuit 700*e* additionally includes switching devices Q710H2161 to Q710H3240 and Q710L2161 to Q710L3240 provided for driving the scan electrodes SC2161 to SC3240. The other is that, compared with the scan pulse generator circuit 700*b*, a scan pulse generator circuit 700*f* additionally includes switching devices Q710H3241 to Q710H4320 and Q710L3241 to Q710L4320 provided for driving the scan electrodes SC3241 to SC4320. The scan pulse generator circuit 500 and the ramp generator circuit 600 have the same configurations as FIG. 4.

Using the above-described scan electrode drive circuit enables a writing pulse to be applied to the scan electrode SC2161 simultaneously with application of a writing pulse to the scan electrode SC1 in a writing period of the first display electrode pair group. Similarly, in a writing period of the second display electrode pair group, a writing pulse is applied to the scan electrode SC3241 simultaneously with application of a writing pulse to the scan electrode SC1081. As a result, writing actions are performed simultaneously both in the upper display area and in the lower display area in the PDP 101, thereby driving the PDP 101 using the same drive waveform as the operations performed when n=2160.

The sustain electrode drive circuit (not shown) may have the same configuration as FIG. 5. Specifically, the sustain electrodes SU2161 to SU3240 may be additionally connected to the sustain electrode drive circuit which is connected to the sustain electrodes SU1 to SU1080, and the sustain electrodes SU3241 to SU4320 may be additionally connected to the circuit which is connected to the sustain electrodes SU1081 to SU2160.

<Drive Method for PDP>

Now, a description is given of a drive method for the PDP apparatus 1000 having the above structure. The drive method is also disclosed in Japanese Patent Application No. 2008-116719, for example. In the present embodiment, timing of scan pulses and writing pulses is determined so that writing actions are successively performed except for initialization periods. Consequently, the greatest possible number of subfields (S. F.) is provided within one field period. In the present embodiment, the drive method for driving the panel is described, with the assumption that n=2160.

(Time Setting for Subfield in Each Group)

Figure 8:
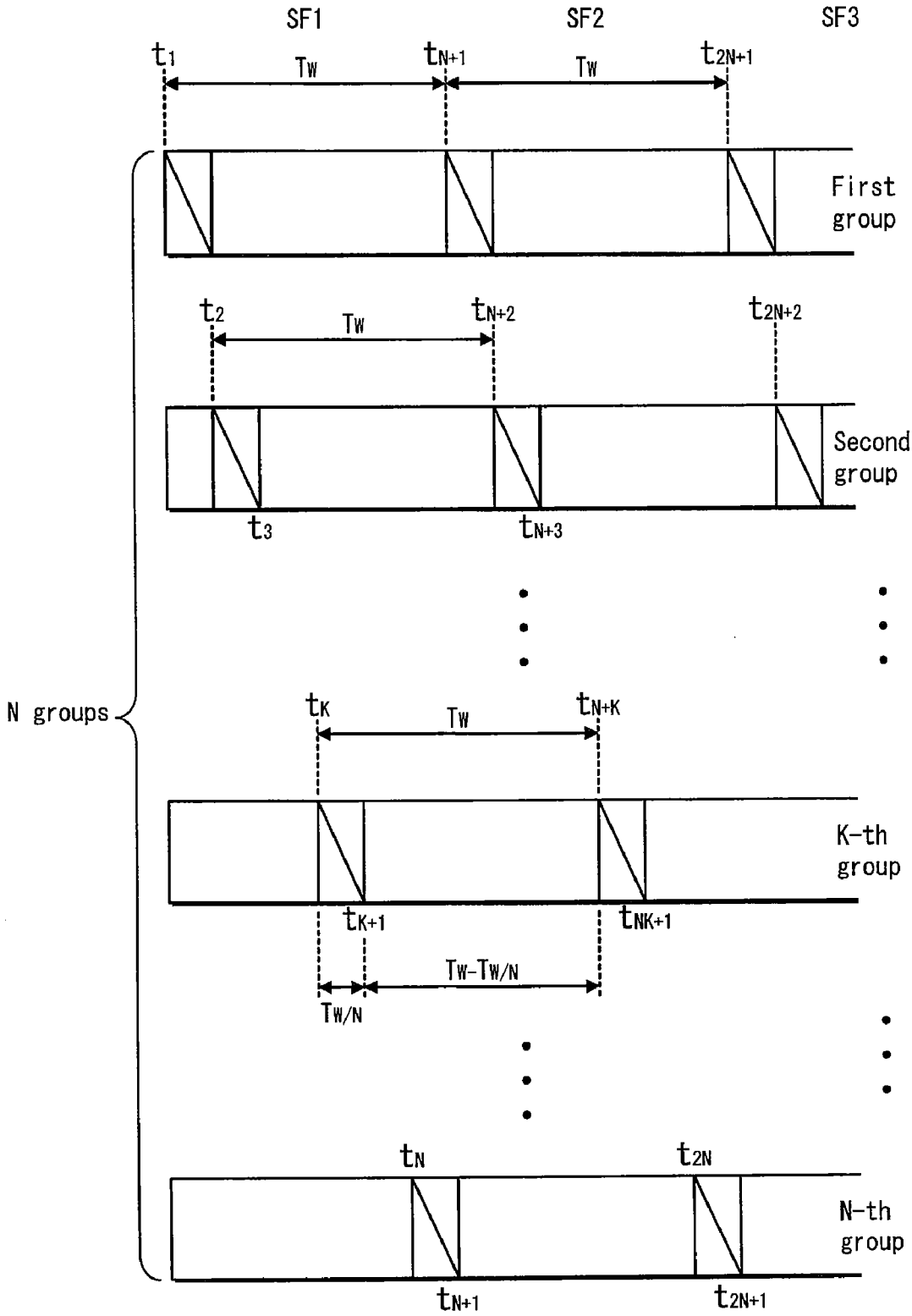
FIG. 8 is a view illustrating a time chart at a time of driving the PDP apparatus according to the embodiment.

To begin with, with reference to a time chart of FIG. 8, a description is given of a way in which start time etc. of each subfield is determined in each of N display electrode pair groups.

In the drive method described here, the start time of each subfield is offset from one display electrode pair group to another display electrode pair group so that writing periods in two or more of the N display electrode pair groups do not overlap with each other. This is similar to the drive method disclosed in Patent Literature 4. However, the drive method of the present invention differs from Patent Literature 4 in the following point. When it is assumed that a time Tw is required to perform a writing action once for each discharge cell in the whole PDP 1, the time spent for the sustain period included in each subfield in each display electrode pair group is set to be Tw×(N−1)/N or less.

In other words, the following inequation (1) is satisfied.

$Ts \leqq Twx(N-1)/N$ (where $Ts$ denotes a time allocated for a sustain period included in a subfield having the greatest luminance weighting) [Inequation (1)]

With the above settings, the PDP apparatus 1000 is enabled to separately allocate writing periods to each display electrode pair group so that writing actions are successively performed across the N display electrode pair groups within the whole one field period except for the initialization periods. In contrast, in the drive method of Patent Literature 4, only the start time of each subfield is offset from each other so as to prevent temporal overlap of writing periods included in two or more blocks, and a sufficient number of subfields is not necessarily secured.

With reference to the time chart of FIG. 8, a more detailed description is given.

From time point t1 to time point t2, writing of SF1 is performed with respect to the first group. From time point t2 to time point t3, writing of SF1 is performed with respect to the second group. From time point tN to time point tN+1, writing of SF1 is performed with respect to the N-th group. In this way, the writing of SF1 is performed in a fixed time Tw/N (from the time point t1 to the time point tN+1).

Subsequently, from the time point tN+1 to time point tN+2, writing of SF2 is performed with respect to the first group. From the time point tN+2 to time point tN+3, writing of SF2 is performed with respect to the second group, and from time point t2N to time point t2N+1, writing of SF2 is performed with respect to the N-th group.

In this way, the writing of SF2 is performed in the fixed time Tw/N (from the time point tN+1 to the time point t2N+1).

Similarly, writing of SF3 is performed in the fixed time Tw/N (from the time point t2N+1 to time point t3N+1).

Normally, writing of SFK which is the K-th subfield is performed in the fixed time Tw/N (from time point t(K−1)N+1 to time point tKN+1).

When writing actions are successively performed, it takes the time Tw/N to perform one writing action in each group, and duration of each subfield is fixed to the time Tw. Accordingly, the maximum time that can be allocated as a sustain period in one subfield is (Tw−Tw/N)=Tw (1−1/N).

Namely, in the drive method for the PDP 1, if the number N of display electrode pair groups and the time Ts allocated to the sustain period in the subfield having the greatest luminance weighting satisfy the relation Ts≦Twx (N−1)/N, successive writing actions are realized, and the greatest possible number of subfields are provided within one field period.

Furthermore, successive writing actions are performed throughout one field except for the initialization period and the erasing periods included in the subfields of the one field, with respect to one of the display electrode pair groups.

With the above method, the number of subfields sufficient for maintenance of high image quality is secured, even when the PDP 1 is a high-definition or an ultra-high-definition panel.

The following is a concrete example of the subfield settings.

Figures 9A, 9B, 9C, 9D:
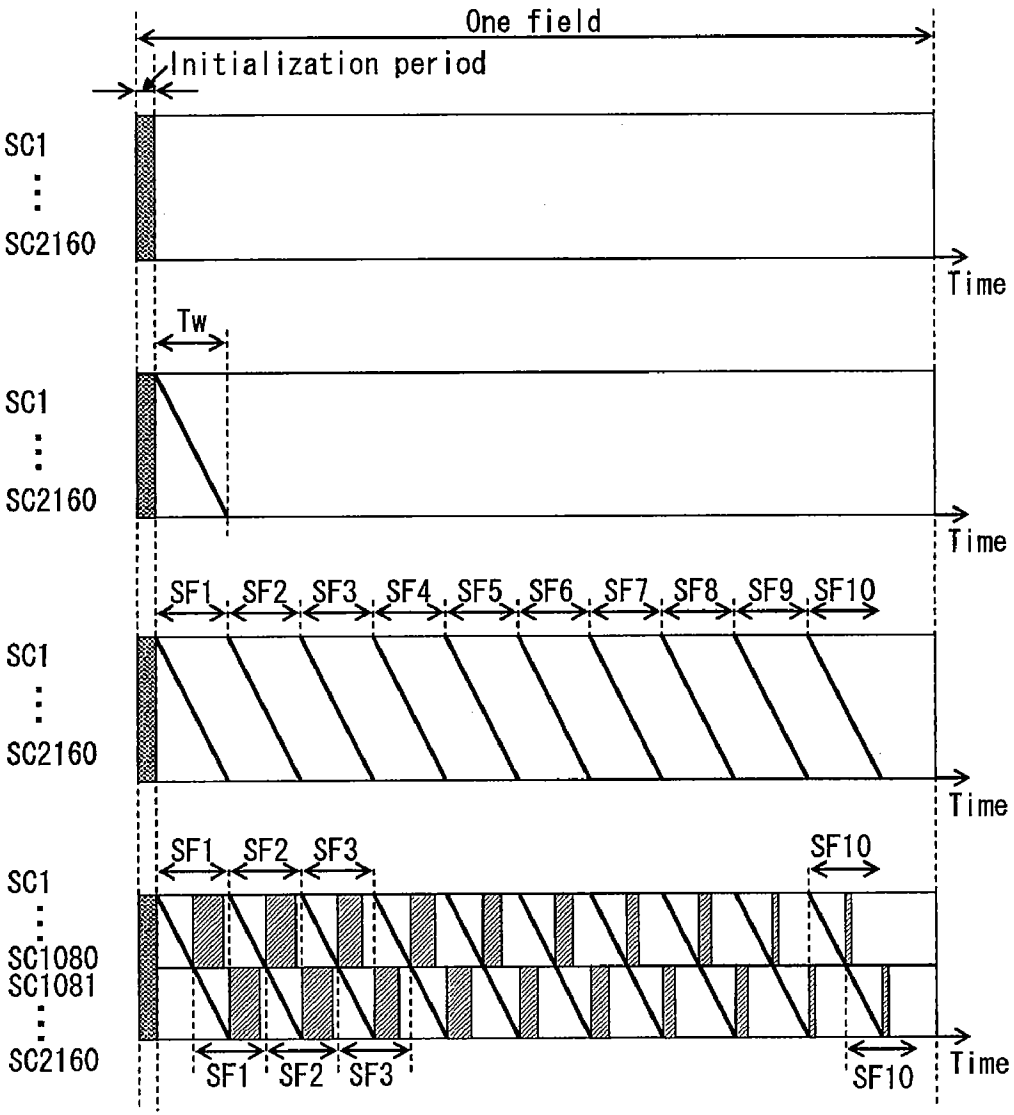
FIG. 9 is a view illustrating a method for setting a subfield configuration in the PDP apparatus according to the embodiment.

FIG. 9 is a view illustrating settings of a subfield in the drive method of the present invention. In FIGS. 9A to 9D, vertical axes represents the scan electrodes SC1 to SC2160, and horizontal axes represents time. Timing of writing actions is indicated by solid lines, and timing of sustain periods and later-described erasing periods are indicated by hatching.

Note that although in the description below one field period is set to be 16.7 ms long, this is not limiting.

Firstly, as shown in FIG. 9A, the initialization period is provided at the start of each field period. In the initialization period, initializing discharge is simultaneously generated in all the discharge cells. In the present embodiment, a time required for the initialization period is set to be 500 μs.

Subsequently, the time Tw required for sequential application of a scan pulse to the scan electrodes SC1 to SC2160 as shown in FIG. 9B is estimated. Here, it is preferable to make the scan pulse shortest possible and apply the scan pulse successively as much as possible, in order to realize successive writing actions. In the present embodiment, a time required for a writing action per one scan electrode is set to be 0.7 μs. Since the number of scan electrodes is 2160, the time Tw required for performing a writing action once for each of all the scan electrodes is 0.7×2160=1512 μs.

Then, the number of subfields is estimated. Note that times required for erasing periods is ignored for now. Deducting the time required for the initialization period from one field period, and dividing the time obtained from the deduction by a time required for performing a writing action once for each scan electrode calculates (6.7−0.5)/1.5=10.8. Thus, as shown in FIG. 9C, ten subfields (SF1, SF2, . . . , and SF10) are secured at maximum.

Subsequently, the number of display electrode pair groups is determined based on the number of sustain pulses that are necessary. In the present embodiment, it is assumed that sustain pulses of "60", "44", "30", "18", "11", "6", "3", "2", "1", and "1" are applied to each subfield. Providing that each sustain pulse has a period of 10 μs, the maximum time Ts required for application of a sustain pulse is 10×60=600 μs.

In this case, the number N of display electrode pair groups is obtained based on the following inequation (2) which is a modification of the inequation (1) mentioned above.

$N \geqq Tw/(Tw-Ts)$ [Inequation (2)]

That is to say, Ts must not exceed Tw (N−1)/N.

In the present embodiment, Tw=1512 μs, and Ts=600 μs. Accordingly, 1512/(1512−600)=1.66, and the number of display electrode pair groups N=2.

In view of the above, as shown in FIG. 2, the display electrode pairs are grouped into two display electrode pair groups. Then, as shown in FIG. 9B, for the scan electrodes belonging to each group, a sustain period for applying a sustain pulse is set subsequent to a writing period. Note that although an erasing period must be provided subsequent to completion of a sustain period in each subfield, both the sustain period and the erasing period are commonly indicated by the hatching of oblique lines rising from left to right in FIG. 9D.

It should be also noted that although erasing periods are ignored in the above calculation, it is preferable to determine not to perform a writing action while any one of the display electrode pair groups is in an erasing period. The reason is that voltage on a data electrode is preferably fixed in an erasing period, since the erasing period is provided not only for erasing the whole wall voltage, but also for adjusting the wall voltage on the data electrode in preparation for a writing action to be performed in the subsequent writing period.

Next, a description is given of the details and operations of the drive voltage waveform.

FIG. 10 is a view showing an example of the drive voltage waveform applied to each electrode included in the PDP.

In the drive method of the PDP 1, an initialization period is provided at the start of each field for generating initializing discharge in the corresponding discharge cell. An erasing period is also provided subsequent to a sustain period included in each subfield in each display electrode pair group for generating erasing discharge in a discharge cell discharged in the sustain period. FIG. 10 shows the initialization period, writing periods included in subfields SF1, SF2, and SF3 with respect to the first display electrode pair group, and subfields SF1 and SF2 with respect to the second display electrode pair group.

The initialization period is described first. In the initialization period, the data electrodes D1 to Dm and the sustain electrodes SU1 to SU2160 are supplied with the voltage 0 (V), the scan electrodes SC1 to SC2160 are applied with the ramp voltage increasing with a gentle slope from the voltage Vi1 to the voltage Vi2. During the voltage increase of the ramp voltage, weak initializing discharge is generated in each of the scan electrodes SC1 to SC2160, the sustain electrodes SU1 to SU2160, and the data electrodes D1 to Dm. Consequently, wall voltage of a negative polarity is accumulated on the scan electrodes SC1 to SC2160, and wall voltage of a positive polarity is accumulated on the data electrodes D1 to Dm and the sustain electrodes SU1 to SU2160. The wall voltage on the electrodes herein refers to voltage generated due to wall charges that have been accumulated on the dielectric layer, the protective layer, the phosphor layer, and the like which cover the electrodes. In addition, the data electrodes D1 to Dm may also be applied with the voltage Vd during the initialization period.

Subsequently, the sustain electrodes SU1 to SU2160 are applied with the positive fixed voltage Ve1, and the scan electrodes SC1 to SC2160 are applied with the ramp voltage decreasing with a gentle slope from voltage Vi3 to voltage Vi4. During the voltage decrease of the ramp voltage, weak initializing discharge is generated in each of the scan electrodes SC1 to SC2160, the sustain electrodes SU1 to SU2160, and the data electrodes D1 to Dm. Consequently, the negative wall voltage accumulated on the scan electrodes SC1 to SC2160 and the positive wall voltage accumulated on the sustain electrodes SU1 to SU2160 are weakened, and the positive wall voltage accumulated on the data electrodes D1 to Dm is adjusted to be a value suitable for the writing action. Subsequently, the scan electrodes SC1 to SC2160 are applied with the voltage Vc. The above processes are performed to complete initialization operations of generating the initializing discharge in all the discharge cells.

Next, a description is given of the writing period included in SF1 with respect to the first display electrode pair group.

The sustain electrodes SU1 to SU1080 are applied with the fixed positive voltage Ve2. The scan electrode SC1 is applied with a scan pulse having the negative voltage Va, and data electrodes Dk (k=1 to m) are applied with writing pulses having the positive voltage Vd, where the data electrodes Dk (k=1 to m) correspond to discharge cells which are formed in the first row in a direction in which emission is to be made. Consequently, a difference in voltage at intersections between the data electrodes Dk and the scan electrode SC1 is a sum of a difference between the externally-applied voltages (Vd−Va) and a difference between the wall voltage on the data electrodes Dk and the wall voltage on the scan electrode SC1, which exceeds the firing voltage. This causes discharge between the data electrodes Dk and the scan electrode SC1, which is developed into discharge between the sustain electrode SU1 and the scan electrode SC1 to generate writing discharge. As a result, positive wall voltage is accumulated on the scan electrode SC1, negative wall voltage is accumulated on the sustain electrode SU1, and negative wall voltage is also accumulated on the data electrodes Dk. Thus, the writing action of accumulating wall voltage on each electrode is performed, by generating writing discharge in the discharge cells formed in the first row in the direction in which emission is to be made. On the other hand, regarding the rest of the data electrodes D1 to Dm which have not been supplied with a writing pulse, voltage at the intersections between the data electrodes and the scan electrode SC1 does not exceed the firing voltage, and therefore writing discharge is not generated there.

Subsequently, the scan electrode SC2 in the second row is applied with a scan pulse, and data electrodes Dk corresponding to the discharge cells formed in the second row in the direction in which emission is to be made are applied with writing pulses. In the discharge cells in the second row which have been simultaneously applied with the scan pulse and the writing pulses, writing discharge is generated, and writing actions are performed.

The above-described writing actions are repeatedly performed until the discharge cell in the 1080-th line, while writing discharge is selectively generated only in the discharge cells to be emitted to form wall charges there.

The writing period included in SF1 with respect to the first display electrode pair group coincides with a rest period included in SF1 with respect to the second display electrode pair group. The scan electrodes SC1081 to SC2160 belonging to the second display electrode pair group are supplied with voltage Vi1. The sustain electrodes SU1081 to SU2160 are applied with the fixed voltage Ve2. In this way, in the rest period, the scan electrodes SC1081 to SC2160 are maintained at a maximum possible potential. This prevents an increase in the wall charges, thereby allowing stable writing actions in the subsequent writing period. It should be noted, however, that the voltage applied to each electrode belonging to the second display electrode pair group is not limited to the above, and other voltage may be applied as long as application of the voltage does not generate discharge.

Next, a description is given of a writing period included in SF1 with respect to the second display electrode pair group.

The sustain electrodes SU1081 to SU2160 are continuously applied with the fixed voltage Ve2. Subsequently, the scan electrode SC1081 is applied with a scan pulse, and the data electrodes Dk corresponding to the discharge cells to be emitted are applied with writing pulses. The above generates writing discharge between the data electrodes Dk and the scan electrode SC1081, and between the sustain electrode SU1081 and the scan electrode SC1081. Subsequently, the scan electrode SC1082 is applied with a scan pulse, and the data electrodes Dk corresponding to the discharge cells to be emitted are applied with writing pulses. In the discharge cell in the 1082-th row which has been simultaneously applied with the scan pulse and the writing pulse, writing discharge is generated.

The above-described writing actions are repeatedly performed until the discharge cell in the 2160-th line, while the writing discharge is selectively generated only in the discharge cells to be emitted to form wall charges there.

The writing period included in SF1 with respect to the second display electrode pair group coincides with a sustain period included in SF1 with respect to the first display electrode pair group. Accordingly, the scan electrodes SC1 to SC1080 and the sustain electrodes SU1 to SU1080 are alternately applied with the sustain pulse of "60", so as to cause the discharge cells in which the writing discharge has been generated to emit light.

Specifically, firstly, the scan electrodes SC1 to SC1080 are applied with the positive voltage Vs, and the sustain electrodes SU1 to SU1080 are applied with the voltage 0 (V). Consequently, in the discharge cells in which the writing discharge has been generated, a difference between the wall voltage on the scan electrode SCi and the wall voltage on the sustain electrode Sui is summed up with the pulse voltage, which exceeds the firing voltage. This generates sustain discharge between the scan electrode SCi and the sustain electrode SUi, thereby generating an ultraviolet ray which causes the phosphor layer 35 to emit light. As a result, negative wall voltage is accumulated on the scan electrode SCi, and positive wall voltage is accumulated on the sustain electrode SUi. Meanwhile, in the discharge cells in which no writing discharge is generated in the writing period, the sustain discharge is not generated, and wall voltage at the completion of the initialization period is maintained there.

Subsequently, the scan electrodes SC1 to SC1080 are applied with the voltage 0 (V), and the sustain electrodes SU1 to SU1080 are applied with the voltage Vs. Consequently, in the discharge cells in which the sustain discharge has been generated, a difference between the voltage on the sustain electrode SUi and the voltage on the scan electrode SCi exceeds the firing voltage. Accordingly, sustain discharge is generated again, whereby negative wall voltage is accumulated on the sustain electrode SUi and positive wall voltage is accumulated on the scan electrode SCi. After that, a sustain pulse is alternately applied to the scan electrodes SC1 to SC1080 and the sustain electrodes SU1 to SU1080 to yield a difference in potential between the electrodes in each display electrode pair. By doing so, sustain discharge is continuously generated in the discharge cells in which the writing discharge has been generated in the writing period, causing the discharge cells to emit light.

The sustain pulse alternately applied to the display electrode pairs refers to a sustain pulse which regulates timing whereby the scan electrodes SC1 to SC1080 are at a high potential simultaneously with the sustain electrodes SU1 to SU1080. Specifically, when the scan electrodes SC1 to SC1080 are applied with the positive voltage Vs, and the sustain electrodes SU1 to SU1080 are applied with the voltage 0 (V), the voltage on the scan electrodes SC1 to SC1080 are increased from the voltage 0 (V) to the voltage Vs firstly, and then the voltage of the sustain electrodes SU1 to SU1080 is decreased from the voltage Vs to the voltage 0 (V). When the scan electrodes SC1 to SC1080 are applied with the voltage 0 (V), and the sustain electrodes SU1 to SU1080 are applied with the positive voltage Vs, the voltage on the sustain electrodes SU1 to SU1080 is increased from the voltage 0 (V) to the voltage Vs firstly, and then the voltage of the sustain electrodes SC1 to SC1080 is decreased from the voltage Vs to the voltage 0 (V).

By applying the sustain pulses to maintain the timing whereby the scan electrodes SC1 to SC1080 are at a high potential simultaneously with the sustain electrodes SU1 to SU1080 as mentioned above, stable and continuous sustain discharge is realized without being affected by writing pulses applied to the data electrodes. The following describes the reason.

Assume that, when the scan electrodes SC1 to SC1080 are applied with the voltage 0 (V), and the sustain electrodes SU1 to SU1080 are applied with the voltage Vs, the voltage on the scan electrodes SC1 to SC1080 is decreased from the voltage Vs to the voltage 0 (V) firstly, and then the voltage on the sustain electrodes SU1 to SU1080 is increased from the voltage 0 (V) to the voltage Vs. In this case, between one of the scan electrodes SC1 to SC1080 and the corresponding data electrode, discharge might be generated once the voltage on the one of the scan electrodes SC1 to SC1080 is decreased, if the corresponding data electrode is applied with a writing pulse. This might result in a decrease in the wall charges required for continuation of sustain discharge. Assume also that, when the scan electrodes SC1 to SC1080 are applied with the voltage Vs, and the sustain electrodes SU1 to SU1080 are applied with the voltage 0 (V), the voltage on the sustain electrodes SU1 to SU1080 is decreased from the voltage Vs to the voltage 0 (V) firstly, and then the voltage on the scan electrodes SC1 to SC1080 is increased from the voltage 0 (V) to the voltage Vs. In this case, between one of the sustain electrodes SU1 to SU1080 and the corresponding data electrode, discharge might be generated once the voltage on the one of the sustain electrodes SU1 to SU1080 is decreased, if the corresponding data electrode is applied with a writing pulse. This might result in a decrease in the wall charges required for continuation of sustain discharge.

Generally speaking, when discharge is generated once the voltage on one of electrodes in a display electrode pair is decreased, and thereby the amount of wall charges is decreased, sustain discharge cannot be generated, or only weak sustain discharge is generated in response to a sustain pulse applied by increasing the voltage on the other electrode in the pair. This prevents accumulation of sufficient wall charges and brings about a risk that sustain discharge is not continuously generated.

To address the above problem, in the drive method of the present invention, a sustain pulse is applied, while the voltage on one of electrodes in a display electrode pair is increased firstly, and then the voltage on the other electrode in the pair is decreased. Accordingly, there is no risk of discharge generated between the one of electrodes and the corresponding data electrode prior to the application of the sustain pulse, even when a writing pulse is applied to the corresponding data electrode. As a result, stable and continuous sustain discharge is realized regardless of presence or absence of a writing pulse.

The sustain period is followed by the two (i.e. the first and the latter) erasing periods and the rest period. In the first erasing period, the scan electrodes SC1 to SC1080 are applied with ramp voltage increasing to the voltage Vr to erase the wall voltage on the scan electrode SCi and the sustain electrode SUi, while the positive wall voltage on the data electrodes Dk is retained. Performing such an erasing operation requires a certain amount of time. The voltage on the data electrodes should preferably be fixed in an erasing period, since the erasing period is provided not only for erasing the whole wall voltage, but also for adjusting the wall voltage on the data electrode in preparation for a writing action to be performed in the subsequent writing period. For this reason, in the drive voltage waveform of the drive method according to the present invention, the writing action with respect to the second display electrode pair group is interrupted during the erasing period with respect to the first display electrode pair group.

Subsequent to the first erasing period is the rest period in which discharge is not generated with respect to the first display electrode pair group. In the rest period, the scan electrodes SC1 to SC1080 are applied with the voltage 0 (V) firstly, and then the sustain electrodes SU1 to SU1080 are applied with the voltage Ve2. On the other hand, the writing operation is resumed with respect to the second display electrode pair group. Until the completion of writing of the scan electrode SC2160, operations of the rest period are maintained with respect to the first display electrode pair group.

Subsequent to the rest period is the latter erasing period with respect to the first display electrode pair group. In the latter erasing period, the sustain electrodes SU1 to SU1080 are applied with the fixed voltage Ve1 firstly, and then the scan electrodes SC1 to SC1080 are applied with the ramp voltage decreasing to the voltage Vi4. This is to adjust the wall voltage on the data electrodes in preparation for a writing action in the subsequent writing period. The latter erasing period is immediately followed by a writing period in which the writing action is started with the scan electrode SC1. By thus starting the writing action immediately after the application of the ramp voltage waveform decreasing towards the voltage Vi4, a decrease in the wall charges is suppressed, whereby stable writing actions are performed in the subsequent writing period.

Next, a description is given of the writing period included in SF2 with respect to the first display electrode pair group.

In the writing period, the sustain electrodes SU1 to SU1080 are continuously applied with the fixed voltage Ve2. The scan electrodes SC1 to SC1080 are sequentially applied with scan pulses as is the case in the writing period included in SF1. At the same time, the data electrodes Dk are applied with writing pulses to perform writing actions in the discharge cells from the 1-st to the 1080-th lines.

When the writing period starts with respect to the first display electrode pair group, a sustain period starts with respect to the second display electrode pair group. That is to say, the scan electrodes SC1081 to SC2160 and the sustain electrodes SU1081 to SU2160 are alternately applied with the sustain pulse of "60", so as to cause the discharge cells in which the writing discharge has been generated to emit light.

The sustain pulse alternately applied to the display electrode pairs refers to a sustain pulse which regulates timing whereby the scan electrodes SC1081 to SC2160 are at the high potential simultaneously with the sustain electrodes SU1081 to SU2160.

The sustain period is followed by two (i.e. the first and the latter) erasing periods and a rest period. In the first erasing period, the scan electrodes SC1081 to SC2160 are applied with ramp voltage increasing to the voltage Vr to erase the wall voltage on the scan electrode SCi and the sustain electrode SUi, while the positive wall voltage on the data electrodes Dk is retained. In this first erasing period with respect to the second display electrode pair group also, the writing action with respect to the first display electrode pair group is interrupted.

Subsequent to the first erasing period is the rest period in which discharge is not generated with respect to the second display electrode pair group. In the rest period, the scan electrodes SC1081 to SC2160 are applied with the voltage 0 (V) firstly, and then the sustain electrodes SU1081 to SU2160 are applied with the voltage Ve2. On the other hand, the writing operation is resumed with respect to the first display electrode pair group. Until the completion of writing of the scan electrode SC1080, operations of the rest period are maintained with respect to the second display electrode pair group.

Subsequent to the rest period is the latter erasing period with respect to the second display electrode pair group. In the latter erasing period, the sustain electrodes SU1081 to SU2160 are applied with the fixed voltage Ve1 firstly, and then the scan electrodes SC1081 to SC2160 are applied with the ramp voltage decreasing to the voltage Vi4. This is to adjust the wall voltage on the data electrodes in preparation for a writing action in the subsequent writing period. The latter erasing period is immediately followed by a writing period in which the writing action is started with the scan electrode SC1. By thus starting the writing action immediately arfter the application of the ramp voltage waveform decreasing towards the voltage Vi4, a decrease in the wall charges is suppressed, whereby stable writing actions are performed in the subsequent writing period.

After the latter erasing period, the writing period included in SF2 with respect to the second display electrode pair group, a writing period included in SF3 with respect to the first display electrode pair group, . . . , and a writing period included in SF10 with respect to the second display electrode pair group follow. Finally, the one field is terminated by a sustain period and an erasing period included in SF10 with respect to the second display electrode pair group.

As mentioned above, in the drive method of the present invention, timing of the scan pulses and the writing pulses are determined so that writing actions are successively performed in one of the display electrode pair groups after the initialization period. As a result, ten subfields are provided within one field period. The number of subfields is the greatest number that can be provided within one field period in the present embodiment.

Furthermore, in the drive method of the present invention, each field is terminated by the sustain period and the erasing period with respect to the second display electrode pair group. Accordingly, by setting a subfield having the smallest luminance weighting as the last subfield, the drive time is shortened.

Meanwhile, in the drive method according to the present embodiment, the voltage Vi1 is 150 (V), the voltage Vi2 is 400 (V), the voltage Vi3 is 200 (V), the voltage Vi4 is −150 (V), the voltage Vc is −10 (V), the voltage Vb is 150 (V), the voltage Va is −160 (V), the voltage Vs is 200 (V), the voltage Vr is 200 (V), the voltage Ve1 is 140 (V), the voltage Vet is 150 (V), and the voltage Vd is 60 (V). Furthermore, the rising ramp voltage and the falling ramp voltage applied to the scan electrodes SC1 to SC2160 have ramp rates of 10 (V/μs) and −2 (V/μs), respectively. However, the voltage values and ramp rates are not limited to the above, and should be appropriately determined in accordance with discharge characteristics and specification of the PDP.

Furthermore, the description has been made of the exemplary subfield structure of FIG. 9 in which the phases with respect to the first display electrode pair group and the second display electrode pair group are offset with each other in all the subfields. However, application of the present invention is not limited to the above subfield structure, and is possible to a subfield structure containing several subfields of a writing/sustainance separation system using an uniform phase in a sustain period for all the discharge cells.

Meanwhile, in the PDP 1, the protective layer is prevented from deterioration due to adherence of the impurity gas attributed to the organic components generated in the manufacturing processes, whereby excellent secondary electron emission properties are maintained. Accordingly, when driven by the above-described drive method, the PDP 1 is enabled to exhibit excellent image display performance with a low electric power consumption. Such an effect is exerted, particularly when the PDP 1 is configured to have the high-definition or the ultra-high-definition cell structure with cells smaller than those of a full HD panel, and driven at a high speed according to the above drive method.

Generally, it is demanded that a protective layer should optimally maintain and exhibit secondary electron emission properties inside the PDP over a period from the time of manufacturing to the time of use. The demand is important in terms of reduction of the drive voltage, for example, in a case where the partial pressure of Xe in the discharge gas is increased for improving efficiency of the PDP. This is true in particular in a PDP like the exemplary PDP 1 having the high-definition or the ultra-high-definition cell structure with resolution greater than that of a full HD panel, or a large-sized PDP with a great number of scan lines, in order to realize excellent image display performance while suppressing an increase in the electric power consumption.

In view of the above, in the present invention, the front substrate 2 and the back substrate 9 are sealed together by heating in a mixed gas atmosphere consisting essentially of a non-oxidizing gas and a reducing gas in the manufacturing processes of the PDP 1. The heating in a predetermined mixed gas atmosphere substantially free from oxygen prevents the organic components from remaining in the discharge space discharge space as a result of being oxidized and polymerized during the heating. The organic components refer to a binder and solvent included in a sealing material paste which is a precursor of the sealing portion 16, for example. The organic components remain still as low molecular components, and therefore effectively evacuated and removed from the inside of the panel in the subsequent evacuating step. This prevents the organic components from adhering to the protective layer 8 as the impurity gas to deteriorate the protective layer 8 and degrade its secondary electron emission properties.

It can be considered that the higher the definition of the high-definition PDP or the ultra-high-definition PDP is, the more effectively such effects of the present invention are excerted. In such a PDP with small cells, a surface area of the discharge cells facing the discharge space is relatively large, and a gas cannot flow freely within the discharge space. Accordingly, in addition to the above-described organic components attributed to the sealing material paste, a relatively large amount of various organic components included in the components of the PDP, such as the phosphor and the barrier ribs, might adhere to the protective layer 8. As an example, the surface area of the cells being in contact with the gas in the discharge space in a 50 inch visual size full HD panel is approximately 2.4 times larger than that in a 42 inch visual size full HD panel. Thus, it is considered that, as the cells get smaller, the impurities are more likely to adhere to the protective layer for the increased size of the surface area. The effects of the present invention are effectively exerted in proportion to such an increase in the surface area.

As has been described, applying the prevent invention in particular to the PDP with small cells brings about the effect of preventing deterioration of the protective layer due to adherence of the impurities, thereby maintaining the optimal secondary electron emission properties. As a result, the drive voltage of the PDP 1 is optimally decreased.

Furthermore, it is expected that the excellent low power consumption driving and the excellent image display performance is also achieved in a PDP having a rib structure in a deep honey comb shape for the same reasons as the above, since the rib structure requires a relatively large surface area facing the discharge space which is likely to retain the gas.

Meanwhile, in the present invention, a predetermined amount of the reducing gas, such as a hydrogen gas, is added to the mixed gas atmosphere (e.g. adding the $H_2$ gas at a partial pressure of 0.1% to 3% inclusive with respect to the whole mixed gas atmosphere) in the sealing step. Presumably, owing to the reducing effect of the reducing gas, unwanted oxidization of the protective layer is prevented, and oxygen-deficiency is formed in a region of a crystalline structure of MgO forming the protective layer. Once the oxygen-deficiency is formed, the region can become a center of emission, thereby possibly improving the secondary electron emission properties of the protective layer 8.

With the protective layer that is capable of exhibiting excellent electron emission properties, the PDP 1 of rapid responsiveness is enabled to optimally drive at a high speed while exhibiting excellent image display performance, even when the drive method targeted for the PDP with small cells is applied. In this regard, it can be said that the PDP obtained by the manufacturing method of the present invention is particularly suitable for use in combination with the predetermined drive method (see FIGS. 3 to 10) employing the above-described drive circuits 111 to 113.

The following describes the manufacturing method for the PDP according to the present invention.

<Manufacturing Method for PDP>

Figure 11:
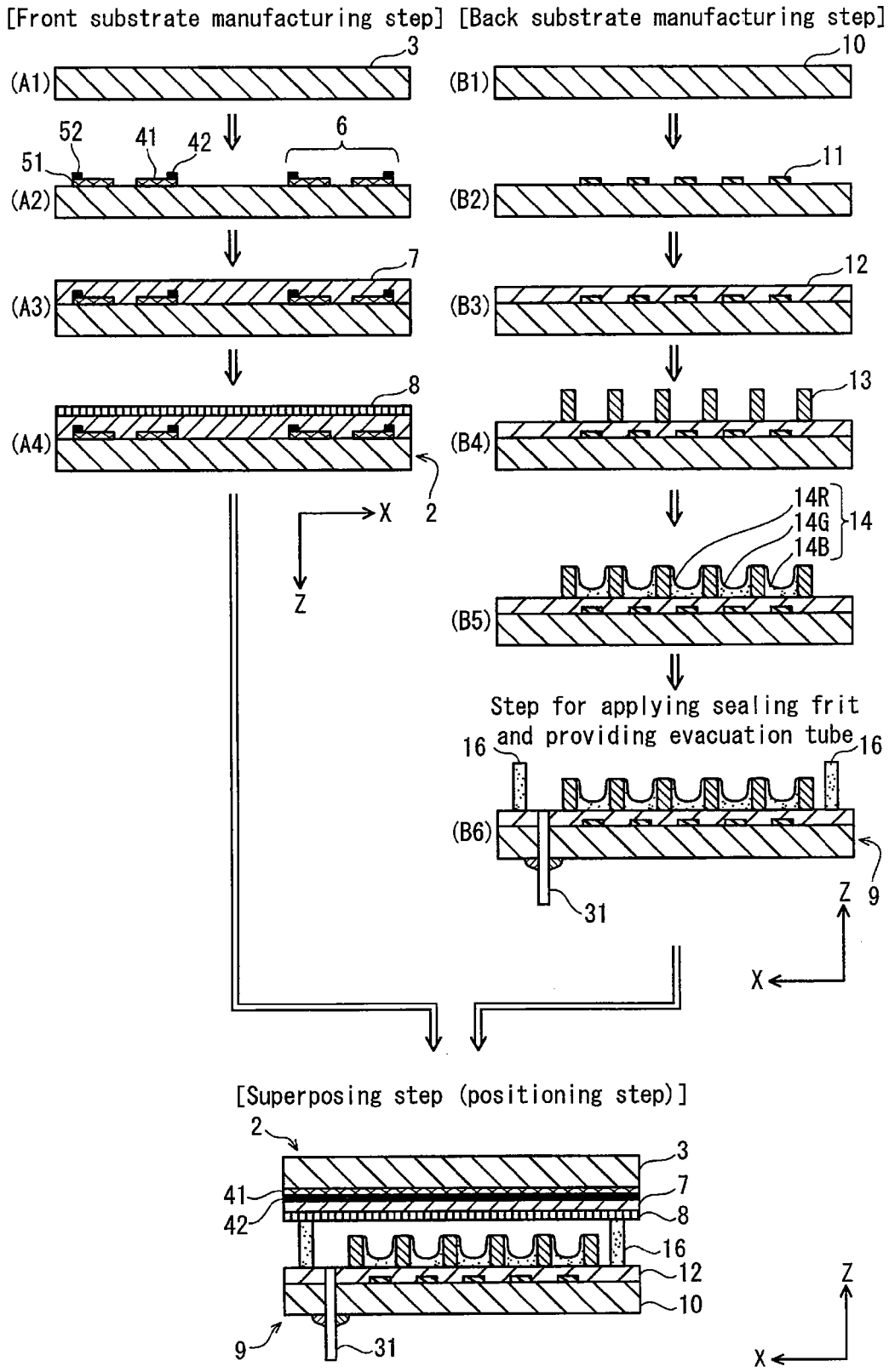
FIG. 11 is a flowchart illustrating a manufacturing method for the PDP of the PDP apparatus according to the embodiment.
Figure 14:
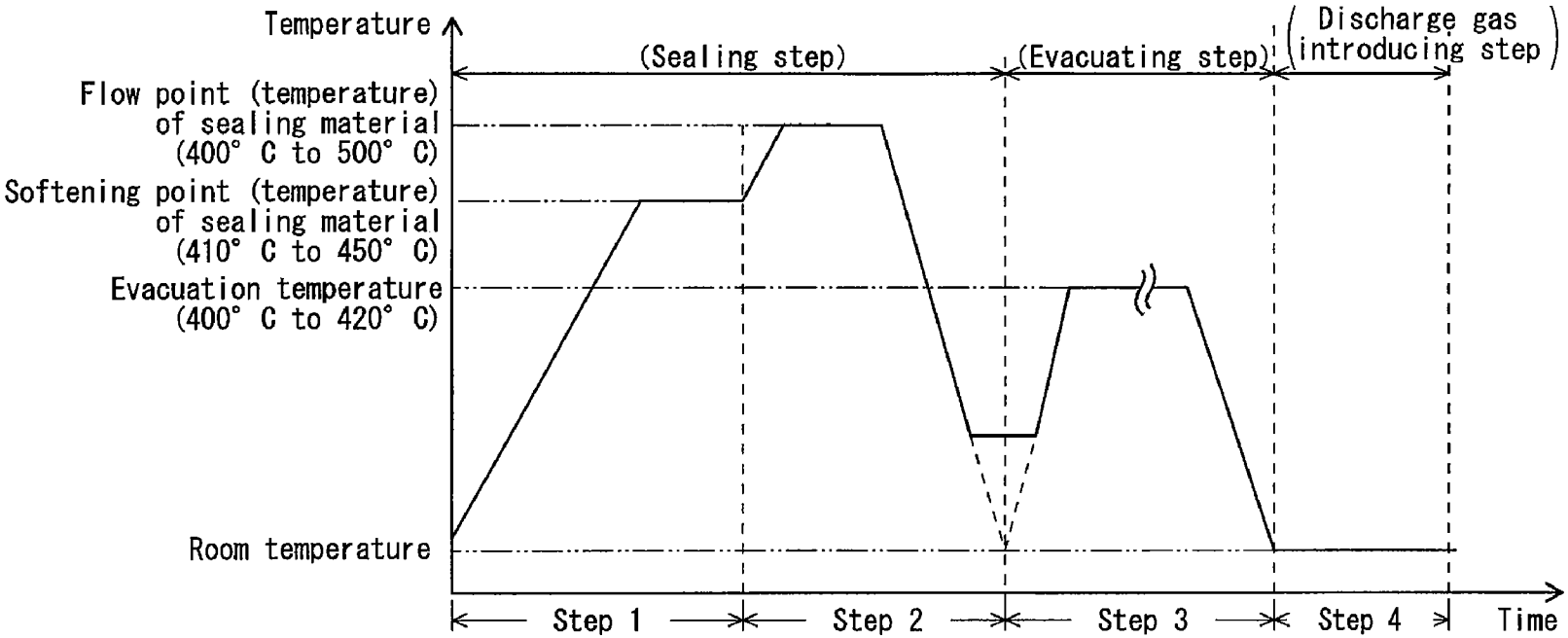
FIG. 14 is a view showing the temperature profile in a sealing step, an evacuating step, and a discharge gas introducing step.

FIG. 11 is a flowchart illustrating the manufacturing method for the PDP 1. As shown in FIG. 11, in the manufacturing processes, the front substrate 2 is manufactured (steps A1 to A4), and the back substrate 9 is separately manufactured (steps B1 to B6). One of the manufactured two substrates 2 and 9 is superposed on the other in a predetermined positional relation (superposing step and positioning step). Subsequently, the sealing step, the evacuating step, and the discharge gas introducing step as shown in FIG. 14 are sequentially performed to complete the PDP 1.

(Front Substrate Manufacturing Step)

The display electrode pairs 6 are formed on a main surface of the front substrate glass 3 (step A2). The description here takes a printing method as an example the forming method for the display electrode pairs 6. The display electrode pairs 6, however, may be formed by other methods, such as a die coating method and a blade coating method.

Firstly, transparent electrode materials, such as ITO, $SnO_2$, and ZnO, are applied on the front substrate glass in a predetermined pattern, such as a stripe pattern, and dried. Thus, transparent electrodes 41 and 51 having a final thickness of approximately 100 nm are formed.

A photosensitive paste containing Ag powder, an organic vehicle, and a photosensitive resin (i.e. photodegradable resin) is prepared, and applied on the transparent electrodes 41 and 51. The applied photosensitive paste is covered by a mask having openings which have been made in accordance with a pattern of bus lines to be formed. After an exposure process on the mask and a development process, the photosensitive paste is baked at a baking temperature of approximately 590° C. to 600° C. Thus, the bus lines 42 and 52 with a final thickness of some μm are formed on the transparent electrodes 41 and 51. Although the screen printing method can conventionally produce a bus line with a width of 100 μm at best, this photomask method enables the bus lines 42 and 52 to be formed as small as 30 μm. Besides Ag, the bus lines 42 and 52 can be made of other metal materials such as Pt, Au, Al, Ni, Cr, tin oxide and indium oxide. Other than the above methods, the bus lines 42 and 52 can be formed, after forming a film made of electrode materials by a deposition method or a sputtering method, by etching the film.

Subsequently, a paste is prepared by mixing (i) lead-based or lead-free low-melting glass with a softening point of 550° C. to 600° C. or $SiO_2$ powder with (ii) the organic binder, such as butyl carbitol acetate. As the glass materials, the bismuth-oxide-based low-melting glass may be prepared to contain, for example, 60 weight % (wt %) of bismuth oxide ($Bi_2O_3$), 15 wt % of boric oxide ($B_2O_3$), 10 wt % of silicon oxide ($SiO_2$), and 15 wt % of zinc oxide (ZnO).

The MgO-containing protective layer 8 is next formed by a vacuum deposition method, the sputtering method, an EB deposition method, or the like (step A4) on the surface of the dielectric layer 7. According to the EB deposition method, by distributing $O_2$ at 0.1 sccm in an EB apparatus using an MgO pellet, the protective layer 8 as a deposited film is obtained.

The above processes are used to complete the front substrate 2.

(Back Substrate Manufacturing Step)

On the main surface of the back panel glass 10, conductive materials composed mainly of Ag are applied with the screen printing method in a stripe pattern at a predetermined interval. Thus, the data electrodes 11 with a thickness of some μm (e.g. approximately 5 μm) are formed (step B2). The data electrodes 11 are made of a metal such as Ag, Al, Ni, Pt, Cr, Cu, and Pd or a conductive ceramic such as metal carbide and metal nitride. The data electrodes 11 may be made of a combination of these materials, or may have a layered structure of these materials as necessary.

In order to obtain the PDP 1 having a 40 inch visual size panel with the high-definition cells, the gap between two adjacent data electrodes 11 needs to be set to be 0.16 mm or less (e.g. in a range from 0.10 mm to 0.16 mm inclusive).

Following that, a glass paste with a thickness of approximately 20 μm to 30 μm made of the lead-based or lead-free low-melting glass or the $SiO_2$ material is applied by the screen printing method all over the back substrate glass 10 on which the data electrodes 11 have formed, and baked to form the dielectric layer 12 (step B3).

Subsequently, the barrier ribs 13 in a predetermined pattern are formed on the dielectric layer 12 (step B4). The barrier ribs 13 are formed as follows. A paste containing a glass particle composed mainly of bismuth oxide, a filler, and a photosensitive resin are applied on the dielectric layer 12 according to the die coating method. The paste is then exposed using a predetermined pattern by the photolithography method, and then etched. The barrier ribs 13 may also be formed by applying a glass-containing paste and dried, and forming a predetermined pattern using a sandblast method.

After the barrier ribs 13 are formed, phosphor ink containing one of red (R), green (G) and blue (B) phosphors commonly used for the AC PDP is applied to the lateral surface of each barrier rib 13 and to the exposed surface of the dielectric layer 12 between adjacent barrier ribs 13. The phosphor ink is then dried and baked to form the phosphor layers 14 (step B5).

The followings are examples of compositions of the red, green and blue phosphors applicable for the formation of the phosphor layers 14.

Red phosphor (Y, Gd) $BO_3$:Eu, Y (P, V) $O_4$:Eu

Green phosphor $Zn_2SiO_4$:Mn, or

MgO or $Al_2O_3$ coated $Zn_2SiO_4$:Mn, (Y, Gd) $BO_3$:Tb, (Y, Gd) $Al_3(BO_3)_4$:Tb Blue phosphor $BaMgAl_{10}O_{17}$:Eu Naturally, the present invention is not limited to these composition examples. In any case, in the PDP with the high-definition cells, stable drive cannot be realized unless all the phosphors have the uniform charged state.

Generally speaking, many of the phosphors utilized in PDPs are positively charged. $Zn_2SiO_4$:Mn which can be used as the green phosphor as mentioned above is negatively charged, and therefore the polarity should be adjusted. Specifically, it is optimal that the phosphor should be coated with positively charged MgO or $Al_2O_3$.

When the green phosphor, $Zn_2SiO_4$:Mn is coated with MgO or $Al_2O_3$ as mentioned above, the back substrate 9 having the phosphor is preferably sealed in the mixed gas atmosphere consisting essentially of the non-oxidizing gas mixed with 0.1% to 3% of the reducing gas, such as $H_2$ and $NH_3$, rather than the non-oxidizing gas consisting essentially only of $N_2$. By doing so, luminance of the panel is effectively improved, while the firing voltage (Vf) is reduced.

As a method for coating aluminum oxide ($Al_2O_3$) or magnesium oxide (MgO) on the surface of $Zn_2SiO_4$:Mn, a solution is prepared by dissolving nitrate salt of Al and Mg, or an organic metal compound (i.e. aluminum nitrate and magnesium nitrate) in water or an alkaline solution. Then, $Zn_2SiO_4$:Mn is added to the prepared solution to obtain a mixed liquid. The obtained mixed liquid is agitated while being heated. The mixed liquid is then filtrated and dried. Subsequently, the dried substance is located in the air and baked at a temperature from 400° C. to 800° C. The above processes are performed to obtain $Zn_2SiO_4$:Mn whose surface is coated with $Al_2O_3$ or MgO. The thickness of the coating film is preferably from 3 nm to 10 nm. However, the thickness of the film may be adjusted by length of time spent for the agitation, the concentration or pH of the mixed liquid, and others.

Each phosphor material has an average particle diameter of preferably 2.0 μm. Each phosphor material is mixed in a server at a ratio of 50 wt %. Then, into the mixed phosphors, 1.0 wt % of ethyl cellulose and 49 wt % of the solvent (i.e. α-terpineol) are poured, and agitated in a sand mill to form a phosphor ink with a viscosity of $1.5\times10^{-2}$ Pa·s. The formed phosphor ink is sprayed into the space formed between adjacent barrier ribs 13 by using a pump through a nozzle having a diameter of 60 μm. At this time, the panel is displaced in a longitudinal direction of the barrier ribs 20, so that the phosphor ink is applied in the stripe pattern. Subsequently, the applied phosphor ink is baked for ten minutes at 500° C., thus forming the phosphor layer 14.

The above processes are used to complete the back substrate 9.

With respect to the back substrate 9, for the sake of the later-performed sealing step, a sealing material paste 16 is disposed along the peripheral edges of the substrate 9 as follows, and then the substrate 9 is pre-baked (step B6).

Application Step and Pre-Baking Step for Sealing Material

To begin with, the resin binder and the solvent are mixed into the predetermined sealing material (e.g. low-melting glass) to obtain the sealing material paste.

As the resin binder, well-known materials, such as an acryl resin, nitrocellulose, ethylcellulose, may be used. As the solvent, well-known materials, such as isoamyl acetate and terpineol, may be used, too. The amount of the resin binder to be applied may be adjusted so that a ratio of the resin binder to the solvent is, for example, approximately 5 wt %.

The softening point of the sealing material at which the sealing material starts to be softened is preferably in a range from 410° C. to 450° C. A flow point (temperature) of the sealing material at which the sealing material starts to gain fluidity is preferably in a range from 450° C. to 500° C. The glass transition point (i.e. glass transition temperature: Tg) of the low melting glass is preferably in a range from 336° C. to 365° C. inclusive.

As an example of the sealing material in harmony with the above temperatures, there is a mixture of a low-melting glass material containing bismuth oxide or lead oxide, and a filler, such as cordierite, $Al_2O_3$ and $SiO_2$. As for the ratio of the low-melting glass and the filler in thus formed sealing material, from 45 to 95 volume % of the low-melting glass and from 5 to 55 volume % of the filler is preferably mixed.

In the case where the bismuth-oxide-based glass is used as a main component in the low-melting glass material, the specific composition of the low-melting glass (after manufacture of the PDP) may be, for example: from 67 to 90 wt % of $Bi_2O_3$; from 2 to 12 wt % of $B_2O_3$; from 0 to 5 wt % of $Al_2O_3$; from 1 to 20 wt % of ZnO; from 0 to 0.3 wt % of $SiO_2$; from 0 to 10 wt % of BaO; from 0 to 5 wt % of CuO; from 0 to 2 wt % of $Fe_2O_3$; from 0 to 5 wt % of $CeO_2$; and from 0 to 5 wt % of $Sb_2O_3$.

On the other hand, in the case where the lead-oxide-based glass is used as a main component in the low-melting glass material, the specific composition of the low-melting glass (after the manufacture of the PDP) may be for example: from 65 to 85 wt % of PbO; from 10 to 20 wt % of $B_2O_3$; from 0 to 20 wt % of ZnO; from 0 to 2.0 wt % of $SiO_2$; from 0 to 10 wt % of CuO; and from 0 to 5 wt % of $Fe_2O_3$.

After the stated adjustment, the obtained sealing material paste is applied along the peripheral edges of the back substrate around the display area of the back substrate (application step for sealing material paste).

The application step for sealing material paste may be performed in a relatively high temperature for the purpose of volatilizing and removing the solvent. However, the application step must be performed in a temperature lower than the softening point of the sealing material, as is the case with the highest pre-baking temperature that is described below.

Subsequently, a plurality of holes are formed around the display area of the back substrate, and a glass tube 31 for evacuating and introducing a gas is inserted into each hole to be fixed therein (see B6 of FIG. 11). The arrangement of the glass tubes 31 may be performed after the sealing step immediately before the evacuating step.

After that, the back substrate is put into a baking furnace, and pre-baked. As the characteristics of the present invention, the highest temperature in the pre-baking step is adjusted to be a low temperature that is higher than or equal to a disappearance point of the binder contained in the sealing material paste (when several types of binders are used, the lowest disappearance temperature of the binders) and lower than the softening point of the sealing material. In the case where the low melting glass is used as a composition of the sealing material, the highest pre-baking temperature is adjusted to be a temperature higher than or equal to the glass transition point of the low melting glass and at least 10° C. lower than the softening point of the low melting glass.

The "disappearance temperature" mentioned above refers to a temperature at which the binder substantially disappears from the paste. Specifically, the disappearance temperature refers to a temperature at least 10° C. lower than the softening point, and more specifically, lower than the softening point by a difference of 10° C. to 50° C.

The heating at a temperature higher than or equal to the softening point of the sealing material oxidizes the organic components included in the sealing material paste, whereby polymer components that do not easily volatilize are generated. The polymer components are not easily removed even in a scrap step, and might be left in both the substrates even after the evacuating step.

If the polymer components are generated and trapped in the inner space within the manufactured PDP, the polymer components are gradually released from the sealing portion into the discharge space to adhere to the protective layer, thereby degrading the secondary electron emission properties of the protective layer. This leads to an increase in the discharge voltage.

Furthermore, the high-definition panels have the finely-partitioned phosphor layer whose surface area is increased by two to four times compared with PDPs conforming to other standards commonly used. As the surface area of the phosphor layer increases, once the polymer components adhere to the phosphor layer, the luminance of the panel is decreased. This leads to degradation of the image display performance.

To address the above problems, in the present invention, adjustment is made to make the organic components remain as the low molecular components without being oxidized, by performing pre-baking step at the predetermined low temperature as mentioned above. As a result, the organic components are effectively removed in the subsequent evacuating step.

Since the sealing material must be melted in the sealing step, the sealing step is performed at a high temperature higher than or equal to the flow point of the sealing material. In the present invention, however, polymerization of the organic components due to oxidization (burning) is effectively prevented, by performing the sealing step not in the non-oxidizing gas consisting essentially of nitrogen ($N_2$) and a rare gas (Ar or the like), but in the mixed gas atmosphere consisting essentially of the non-oxidizing gas mixed with the reducing gas. As a result, deterioration of the protective layer and the phosphor layer is prevented.

Figure 12:
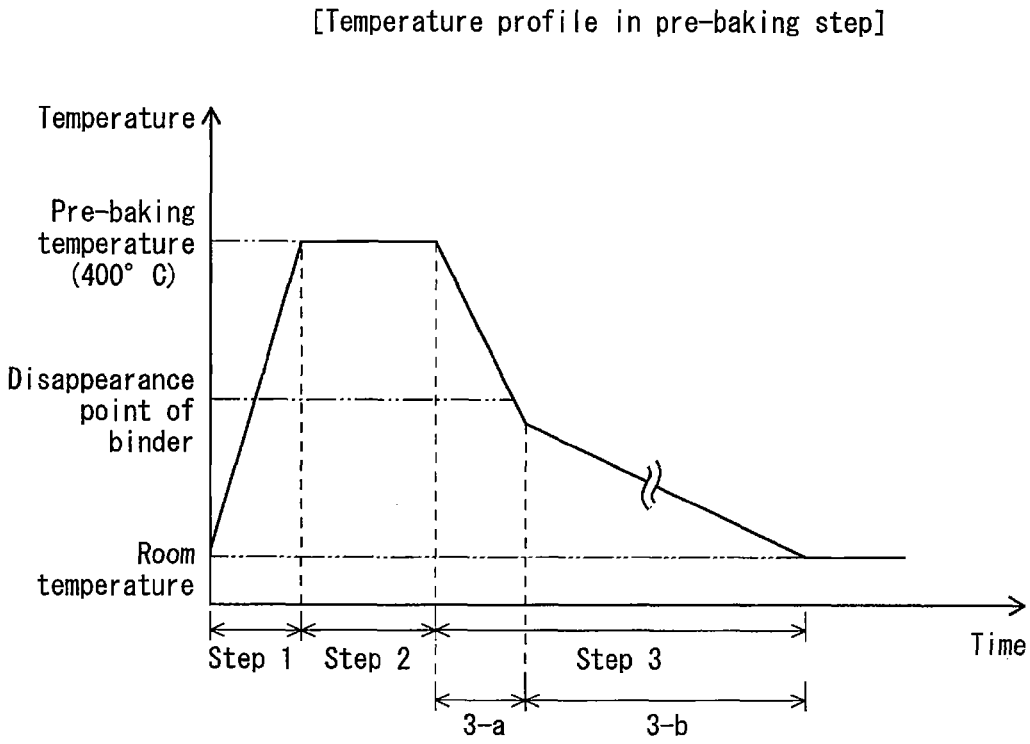
FIG. 12 is a view showing a temperature profile in a pre-baking step according to the present invention.

FIG. 12 is a graph showing an example of a temperature profile in the pre-baking step. The back substrate 9 being in the state shown by B6 of FIG. 11 is put into the baking furnace. At this time, the baking atmosphere can be set to an atmosphere containing a slight amount of oxygen (e.g. an atmosphere containing oxygen at a partial pressure higher than 0% and lower than or equal to 1%). The baking atmosphere may also be set to the non-oxidizing atmosphere (e.g. an atmosphere containing nitrogen with a dew point of −45° C. or lower). In the case where the baking atmosphere is set to the non-oxidizing atmosphere, attention must be paid to fully remove the organic components in the subsequent evacuating step, since the organic components cannot be burned and removed in the pre-baking step.

After the back substrate 9 is put into the furnace, a temperature of the baking furnace is increased from a room temperature up to a pre-baking temperature (400° C.) (step 1: pre-baking temperature increasing step). The pre-baking temperature is the highest temperature in the pre-baking step, and as mentioned above, set to be lower than the softening point of the low melting glass included in the sealing material. In this example, the highest pre-baking temperature (400° C.) is maintained for a certain period of time (e.g. 10 to 30 minutes) to pre-bake the paste (step 2: pre-baking temperature maintaining step).

Subsequently, the temperature of the back substrate 9 is decreased from the highest pre-baking temperature to the room temperature (step 3: pre-baking temperature decreasing step). The temperature decreasing step includes a first decreasing sub-step of decreasing the temperature of the back substrate 9 from the highest pre-baking temperature (400° C.) to a first temperature higher than the disappearance point of the binder and higher than the room temperature ("3-*a*" in FIG. 12). The temperature decreasing step also includes a second decreasing sub-step of decreasing, after the first decreasing sub-step, the temperature of the back substrate 9 from the first temperature to the room temperature ("3-*b*" in FIG. 12). The first decreasing sub-step is performed in a shorter time than the second decreasing sub-step, so that the temperature of the back substrate 9 is relatively rapidly decreased to the first temperature. In the example of the temperature profile, the first temperature is set to be 200° C., and the first decreasing step is performed in a short time ranging from 20 to 30 minutes inclusive. As for the second decreasing sub-step, the temperature of the back substrate 9 is gently decreased further for at least two hours at least until the temperature reaches approximately 50° C.

Specifically, in the case of the temperature profile, a temperature decreasing rate in the first decreasing sub-step is (400-200)/0.5=400 (° C./hr) or higher. A temperature decreasing rate in the second decreasing sub-step is (200-50)/2=75 (° C./hr) or lower. With such a relation between the temperature decreasing rates, the temperature of the back substrate 9 is decreased in the second decreasing sub-step at a temperature decreasing rate at least five times lower than the first decreasing sub-step. In this way, the time required for the second decreasing sub-step is preferably at least five times longer than the time required for the first decreasing sub-step.

Note that the reason why the first decreasing sub-step is limited to 30 minutes at maximum is that a study of the present inventors revealed that performing the sub-step within 30 minutes decreases the electric power consumption of the manufactured PDP more significantly than performing the sub-step for longer than 30 minutes.

As mentioned above, the electric power consumption of the PDP is optimally decreased by performing the first decreasing sub-step within the short period of time with the stated temperature settings. The reason is considered to be that the amount of the impurities released from the sealing portion 16 into the discharge space 15 little by little after the manufacture of the PDP is decreased, whereby deterioration of the MgO-containing protective layer 8 is prevented, resulting in effective prevention of degradation of the secondary electron emission properties. Furthermore, the reason why the amount of the impurities released from the sealing portion 16 is decreased is considered as follows.

As mentioned above, the organic components of the binder included in the sealing material paste are progressively decomposed to low molecular components at a high temperature higher than or equal to the disappearance point of the components. Once decomposed in such a high temperature, the organic components (referred to below as low molecular components) normally disappear due to the heating. However, when the heating temperature is higher than or equal to the softening point of the sealing material, the low molecular components are combined (polymerized) again to turn into tar components of a higher molecular weight which are less volatile. The tar (polymer) components remain in the inner space enclosed by both the substrates even after the evacuating step, possibly causing bad effect on the performance of the PDP.

As is mentioned above, as an effective way to prevent the low molecular components from turning into the tar components, the settings of the pre-baking temperature in the pre-baking step is performed. That is to say, the heating temperature of the organic components of the binder is set to be higher than or equal to the disappearance point of the binder included in the sealing paste and lower than the softening point of the low melting glass included in the sealing material.

The following further describes the pre-baking step. In the step 2 of maintaining the highest pre-baking temperature for the certain period of time, most of the organic components of the binder are decomposed into the low molecular components, and disappear. However, the organic components are not fully decomposed into the low molecular components within the period of step 2, and a slight amount of organic components might still remain as they are.

If the pre-baking temperature were higher than or equal to the disappearance point of the components in a period sometime during the step 3 (pre-baking temperature decreasing step), the residual organic components would be progressively decomposed in the step 3. However, since the pre-baking temperature is gradually decreased in the step 3, the low molecular components generated due to the decomposition in the period in the step 3 are less likely to disappear compared with the step 2 in which the highest pre-baking temperature is maintained. Consequently, the low molecular components are more likely to be incorporated in the sealing portion 16. The components left in the sealing portion 16 are adversely released from the sealing portion 16 as the impurities (impurity gas) in the PDP after the manufacture.

In order to address the above problem, the first decreasing sub-step is provided at the beginning of the step 3 for adjusting the temperature of the back substrate 9 in the example of the temperature profile. In the step 3, the temperature of the back substrate 9 is decreased from the highest pre-baking temperature to the first temperature which is lower than the disappearance point of the binder and higher than the room temperature. The above first decreasing sub-step prevents the organic components from remaining as the low molecular components as much as possible, thereby reducing the amount of the impurities released from the sealing portion 16 into the discharge space 15 in the PDP after the manufacture.

With the above reasons taken into consideration, it appears that the temperature decreasing rate in the first decreasing sub-step is preferably as high as possible. However, when the temperature decreasing rate in the first decreasing sub-step is excessively high, there is a risk that the glass substrates of the PDP are damaged (e.g. broken). Accordingly, the temperature decreasing rate must be determined in consideration of the risk.

Meanwhile, regarding the decreasing sub-steps of decreasing the temperature of the back substrate 9 to the temperature lower than the disappearance point of the binder or to the room temperature, the decomposition of the binder does not occur within the temperature range. Accordingly, the temperature decreasing rate within the temperature range may be arbitraly determined.

Generally, furthermore, the pre-baking step is to burn the solvent and the binder component contained in the sealing material paste, thereby causing carbon dioxide ($CO_2$) to be generated, and then remove the generated $CO_2$. However, the step involves a risk that the glass component of the sealing material is foamed as a result of a rapid generation of carbon dioxide if the atmosphere contains a lot of oxidizing gas, such as oxygen. This might lead to imperfect sealing. Since the imperfect sealing eventually might cause a leakage of a discharge gas, the risk must be avoided.

In order to prevent the glass component from being foamed, it is preferable to utilize a weakly-oxidizing atmosphere with a decreased amount of an oxidizing gas component (e.g. mixed atmosphere consisting essentially of nitrogen as the main component and oxygen, with the partial pressure of the oxygen being 1% or lower) and non-oxidizing atmosphere (e.g. atmosphere consisting essentially of nitrogen) as the pre-baking atmosphere. In a case where an acryl resin is used as a resin component of the sealing material paste or where $Bi_2O_3$-based glass and $P_2O_5$-based glass is used in the sealing material, the pre-baking step is preferably performed in the non-oxidizing atmosphere using $N_2$ or the like.

(Superposing (Positioning) Step)

One of the manufactured front substrate 2 and back substrate 9 is superposed on the other so that the display electrode pairs 6 intersect the address electrodes 11 that face the display electrode pairs 6. In this process, a clip (which is not shown) having a spring structure is held between the substrates 2 and 9 so as to prevent the substrates 2 and 9 from being misaligned with each other. The superposition is performed with the top surfaces of the barrier ribs 13 facing the protective layer 8. In the present invention, the superposing step is performed in an air atmosphere without using a large-sized pressure reducing device, and both the substrates are easily handled. The present invention is therefore extremely useful in the manufacture.

Accordingly, even if the PDP to be manufactured has a large visual size of at least 50 inches, the manufacture is realized at a relatively low cost.

Note that FIG. 11 illustrates the sealing portion 16 prior to the sealing step. After the sealing, the height of the sealing portion 16 is reduced as a result of the glass included in the sealing portion 16 being melted, so that the top surfaces of the barrier ribs 13 abut against the protective layer 8.

Figure 13:
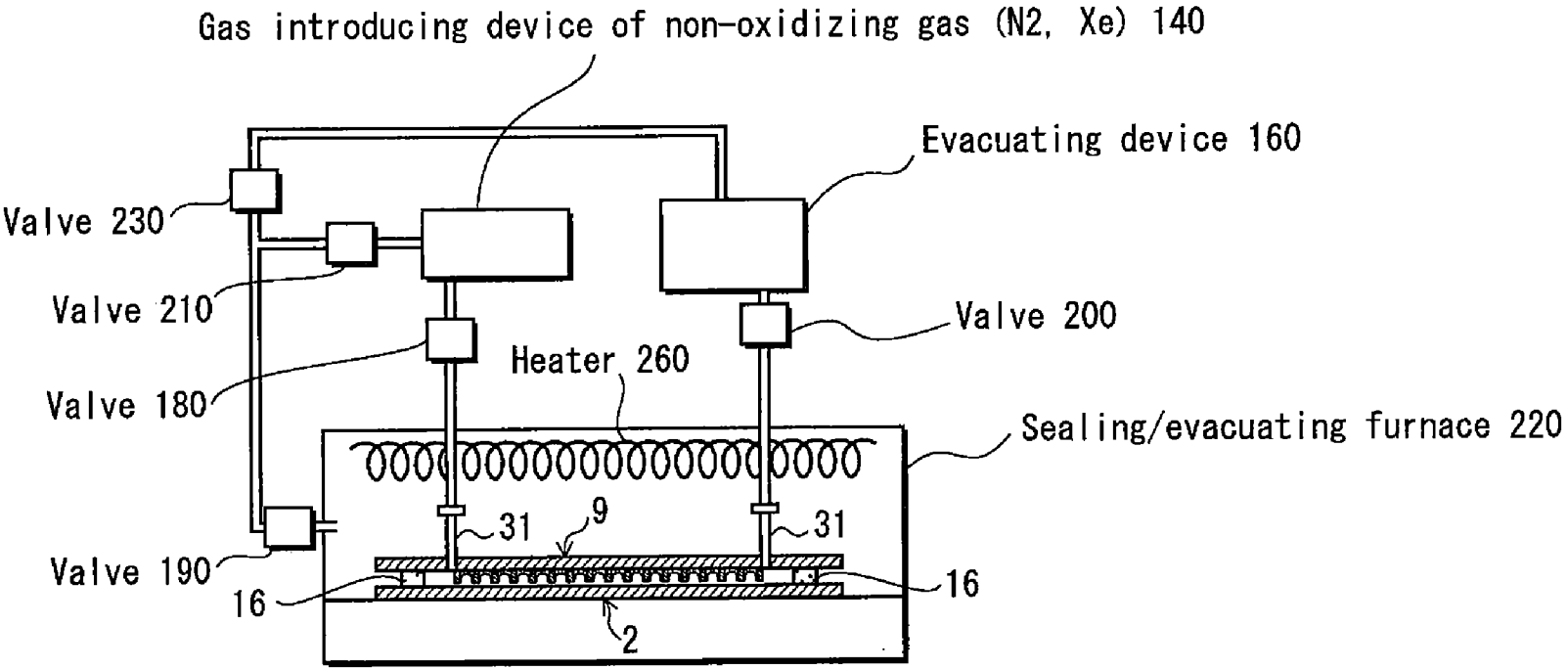
FIG. 13 is a view showing a pipe structure of a sealing device, a gas introducing device, and others.

The substrates held by the clip are put into a heating furnace for sealing and evacuating (i.e. sealing/evacuating furnace). As shown in FIG. 13, an evacuating device 60 and a gas introducing device 140 are connected to the glass tube 31 arranged in the back substrate 9 via pipes.

(Sealing Step, Evacuating Step, and Discharge Gas Introducing Step)

A description is given of the sealing step, the evacuating step, and the discharge gas introducing step with reference to FIGS. 13 and 14. FIG. 13 shows an example of a gas flow system including a sealing/evacuating furnace 220, the evacuating device 160, and the gas introducing device 140 which are connected with each other by given pipes via valves 180, 190, 200, 210, and 230 (note that the gas introducing device 140 of FIG. 13 is capable of causing, in the sealing step, the mixed gas consisting of the non-oxidizing gas mixed (added) with a small amount of the reducing gas to flow, and also capable of introducing the discharge gas). The evacuation, the gas flow, and the gas introduction from/into the inner space enclosed by both the substrates are adjusted by opening and closing one of the valves 180, 190, 200, 210, and 230 at predetermined timing. The valve 190 is also used for adjusting a dew point and a pressure inside the sealing/evacuating furnace 220.

The valves 180, 210, and 230 may also be provided inside the gas introducing device 140, and the valve 200 may also be provided inside the evacuating device 160, for example.

FIG. 14 is a graph showing an example of the temperature profile during the sealing step, the evacuating step, and the discharge gas introducing step. Heating temperatures, other temperatures, and periods for maintaining the temperatures described below are only an example.

In the sealing step, a sealing atmosphere inside the sealing/evacuating furnace 220 is adjusted first. For the adjustment, the valves 190 and 210 are opened to cause the mixed gas atmosphere to flow into the inner space enclosed by both the substrates and inside the sealing/evacuating furnace 220 until the inner space and the furnace 220 are filled. The mixed gas atmosphere herein is prepared by mixing the non-oxidizing gas (e.g. an Ar gas, or the $N_2$ atmosphere with a dew point of −45° C. or lower) with the reducing gas (e.g. the $H_2$ gas) at a predetermined ratio.

As for the ratio, the reducing gas added to the sealing atmosphere (i.e. mixed gas atmosphere) preferably has a partial pressure ranging from 0.1% to 3% inclusive with respect to the whole mixed atmosphere. The firing voltage can be reduced even when the reducing gas to be added has a partial pressure of as small as lower than 0.1%. In this case, however, if the $Zn_2SiO_4$:Mn phosphor coated with MgO or $Al_2O_3$ is used, the coating increases the amount of oxygen and water to be absorbed, thereby hindering the reducing effect of the firing voltage. The partial pressure of the reducing gas higher than 3% is not preferable, either, since, with the reducing gas of such a partial pressure, the dielectric layer is damaged, and display unevenness occurs in the display area of the PDP.

Further, in the actual processes, a slight amount of the oxidizing gas, such as oxygen, included in the air atmosphere might be incorporated into the sealing atmosphere. However, adjustment is made to reduce an influence of the incorporated oxidizing gas as much as possible so that the sealing step is performed in the gas atmosphere substantially containing the non-oxidizing gas and the small amount of the reducing gas. In the present invention, by utilizing the reducing gas as a component of the sealing atmosphere, the bad influence of the oxidizing gas is suppressed as much as possible by a reduction effect of the oxidizing gas, even when the oxidizing gas, such as oxygen, is more or less incorporated. As a result, the organic components are prevented from polymerizing and remaining in the panel.

The dew point and the pressure of the gas within the furnace consisting essentially of the non-oxidizing gas mixed with the small amount of the reducing gas are set by controlling the valve 190, and the pressure is set to be slightly positive. In this state, the valves 180, 190, and 210 are further controlled to supply a current to a heater 260 to heat both the substrates, while the gas consisting essentially of the non-oxidizing gas mixed with the small amount of the reducing gas is caused to flow into the inner space enclosed by both the substrates and the furnace. By the adjustment of the heater 260, the temperature of both the substrates is increased from the room temperature to the softening point of the sealing material (ranging from 410° C. to 450° C.).

Once the temperature of both the substrates is increased to the softening point, as a process for maintaining the sealing temperature, the temperature is maintained for a certain period of time (approximately one hour) (up to this process, step 1). Note that it is not necessary to maintain the temperature at the softening point, and can be omitted, for example, when the temperature should be gently increased to the flow point of the sealing material.

Subsequently, the valve 180 is adjusted to heat both the substrates up to the flow point (i.e. melting temperature ranging from 450° C. to 500° C.) of the sealing material, while the amount of the gas consisting essentially of the non-oxidizing gas mixed with the small amount of the reducing gas, to be caused to flow into the inner space enclosed between the substrates, is limited to approximately half (i.e. sealing temperature increasing sub-step). The flow point is, in other words, a temperature at least 40° C. higher than the softening point of the sealing material. The increased temperature is maintained for a predetermined period of time (approximately one hour) (i.e. sealing temperature maintaining sub-step). Subsequently, as a sealing temperature decreasing sub-step, the temperature is cooled down to an evacuation temperature (ranging from 400° C. to 420° C.) or lower (up to this process, step 2). With the steps 1 and 2, the low melting glass included in the sealing material is melted to have a high density structure first, and then gain solidity again by being cooled, thus forming the completed sealing portion 16.

The above processes are used in the sealing step.

Next, the evacuating step follows. The valve 180 is closed, and the valves 190, 200, and 210 are opened, in order to evacuate the inner space enclosed by both the substrates and the sealing/evacuating furnace 220 to vacuum using the evacuating device 160. In the vacuum state, as a process for increasing the evacuation temperature, the temperature of both the substrates is increased to the predetermined evacuation temperature. Then, as an evacuation temperature maintaining sub-step, the predetermined evacuation temperature is maintained for a predetermined period of time (four hours). The predetermined evacuation temperature is preferably set to be lower than the softening point of the sealing material (more preferably, a temperature lower than the softening point by a difference of 10° C. to 30° C.). Subsequently, as an evacuation temperature decreasing sub-step, the temperature of both the substrates is cooled to the room temperature (step 3).

In the evacuating step according to the present invention, the organic components (CH-based components) attributed to the sealing material paste, which were maintained as the low molecular components in the pre-baking step, evaporate to be removed from the inner space enclosed by both the substrates along with the flowing gas. Since the organic components are not polymerized and remain still as the low molecular components, it is relatively easy to remove the components from the inner surfaces of both the substrates and the sealing material by the gas flow in the evacuating step. Accordingly, the organic components are effectively removed from the inner space enclosed by both the substrates.

Further, in parallel with the above, carbon oxide gases, such as CO and $CO_2$, generated in the inner space enclosed by both the substrates are also removed. Such carbon oxide gases are generated as a result of the organic components slightly remaining between both the substrates being burned. Since the evacuating step is performed at a relatively low temperature, however, the amount of the generated carbon oxide gases is not large, but limited to small.

By performing the above evacuating step, the organic components and the gas components that might deteriorate the protective layer and the phosphor layer by adhering thereto are effectively removed.

Once the temperature of both the substrates is decreased to the room temperature, the evacuating step ends.

Next, the discharge gas introducing step follows. The valves 190, 200, and 210 are closed, and the valve 180 is opened, in order to introduce the discharge gas containing at least 15% of Xe, such as the Ne—Xe-based discharge gas (e.g. 70% Ne-30% Xe gas) from the gas introducing device 140 into the inner space enclosed by both the panels at a predetermined pressure (e.g. 66 KPa).

After the discharge gas is introduced, a tip of the glass tube 31 is sealed by tube-off (Tube-off step). All the above-described steps are used to complete the manufacture of the PDP 1.

As has been mentioned above, the manufacturing method of the present invention focuses on the temperature adjustment in the pre-baking step. Also, according to the manufacturing method, the processes prior to the sealing step do not need to be performed in a closed or an isolated atmosphere. Accordingly, both the substrates under manufacture are enabled to be taken out once to the air atmosphere after the sealing step, and subsequently connected to the evacuating device to perform the evacuating step. Furthermore, both the substrates that have been taken out to the air atmosphere may be temporarily stored before performing the evacuating step.

The present invention therefore omits a need for manufacturing the PDP by performing each process throughout in an atmosphere in a depressurized state which is isolated from the air atmosphere as a conventional technique. Accordingly, an additional manufacturing device, such as the large-sized pressure reducing device, is not required. The present invention also provides an effect that an implementation plan of the manufacturing processes is flexibly adjusted, since both the substrates under manufacture may be stored as mentioned above. Thus, the present invention is highly advantageous in a point that the invention is highly operable.

<Performance Evaluation Experiment>

In order to confirm performance effects of the manufacturing method according to the present invention, performance evaluation experiments were carried out on PDPs manufactured according to examples (Examples 1 to 3) and PDPs manufactured according to comparative examples (Comparative Examples 1 to 2). The discharge voltage of each of the PDPs was measured Manufacturing method for the PDPs was based on the above manufacturing method except for processes specified below.

Example 1

A PDP including small cells with a cell pitch of approximately 0.10 mm was manufactured. In the front substrate manufacturing process, the protective layer containing only MgO was obtained by distributing $O_2$ at 0.1 (sccm) in the EB apparatus using the MgO pellet.

As the phosphors, (Y, Gd) $BO_3$:Eu was used as red phosphors, $Zn_2SiO_4$:Mn was used as green phosphors, and $BaMgAl_{10}O_{17}$:Eu was used as blue phosphors.

As a composition of the sealing material, PbO—$B_2O_3$—RO-MO-based glass composed mainly of lead oxide-based (PbO) glass as shown in later-described Table 1 was used. The softening point of the above sealing material is 430° C., and the flow point of the sealing material is 490° C.

The highest pre-baking temperature (in the step 2 in the temperature profile of FIG. 12) in the pre-baking step was set to be 400° C. which was 30° C. lower than the softening point of the sealing material. The pre-baking step was performed for 50 minutes in the atmosphere.

In the step 1 in the sealing step (i.e. the step 1 in the temperature profile of FIG. 14), the sealing/evacuating furnace 120 was filled with the mixed gas consisting of the $N_2$ gas with a dew point of −50° C., mixed with 0.1% of the $H_2$ gas. Subsequently, the temperature within the furnace was increased approximately to the softening point (420° C.) of the sealing material using the heater 160 inside the sealing/evacuating furnace 220, while the mixed gas consisting of the $N_2$ gas mixed with 0.1% of the $H_2$ gas was caused to flow into the inner space enclosed by both the substrates at a speed 5 L/min (at this time, the valves 200, 190, and 210 of the evacuating device 160 were closed).

Then, in the step 2 in the sealing step (i.e. the step 2 of FIG. 14), further to the step 1, the sealing/evacuating furnace 220 was filled with the mixed gas consisting of the $N_2$ gas with a dew point of −50° C. mixed with the $H_2$ gas, with the partial pressure of the $H_2$ gas being 0.1%. By adjusting the valve 180, the amount of the mixed gas (consisting of the $N_2$ gas mixed with the $H_2$ gas at the partial pressure of 0.1%) to be caused to flow was set to be 2 L/min which was half or less of the amount in the step 1. In this state, the temperature of the sealing/evacuating furnace 220 was increased to the sealing temperature (flow point: 490° C.) at which the sealing material was fully softened. The sealing temperature was maintained for fifty minutes, and then, the temperature within the furnace was decreased to a temperature lower than or equal to the softening point of the sealing material (300° C.).

Further to the sealing step (i.e. the steps 1 and 2), in the evacuating step in the step 3 of FIG. 14, the inner space enclosed by both the substrates and the furnace was evacuated to vacuum, by closing the valves 180 and 210, and opening the valves 200, 190, and 230. Moreover, the temperature of the sealing/evacuating furnace 220 was again increased from 300° C. to 410° C. which is lower than the softening point (by a difference of 20° C.), and maintained at 410° C. for approximately four hours. Subsequently, the temperature inside the furnace was decreased to the room temperature while the furnace was evacuated to vacuum.

In the discharge gas introducing step, the discharge gas of the above-described composition (i.e. 100% Xe) was introduced from the gas introducing device 140 into the inner space enclosed by both the substrate at a pressure of 66 KPa at the room temperature as shown in the step 4 of FIG. 14, by closing the valves 200, 190 and 230, and opening the valve 180.

In the tube-off step, the tube-off was performed on the tip of the glass tube 31, while the pressure in the sealing/evacuating furnace 220 was set back to a normal pressure. All the above steps were performed to obtain the PDP according to Example 1.

Example 2

The sealing step was performed in the mixed gas atmosphere consisting of the $N_2$ gas mixed with the $H_2$ gas, with the partial pressure of the $H_2$ gas being 3.0%, as shown in Table 1. Apart from that, settings in Example 2 are basically the same as Example 1.

Example 3

A PDP including small cells with a cell pitch of approximately 0.15 mm was manufactured. In the front substrate manufacturing process the protective layer composed mainly of the MgO containing the above substances was obtained by distributing $O_2$ at 0.1 (sccm) in the EB apparatus, with use of the MgO pellet with additives of $SiO_2$ and $Al_2O_3$ at concentrations of 100 ppm and 500 ppm, respectively.

As for the composition of the sealing material, the glass composed mainly of $Bi_2O_3$, and the filler containing $Al_2O_3$, $SiO_2$, and cordierite were used in mixture ($Bi_2O_3$-$B_2O_3$—RO-MO-based glass shown in Table 1 was used). The softening point of the above sealing material is 450° C., and the sealing temperature of the sealing material is 500° C.

The highest pre-baking temperature in the pre-baking step was set to be 410° C. which was 40° C. lower than the softening point of the sealing material. The sealing step was performed in the mixed gas atmosphere consisting of the $N_2$ gas with a dew point of −55° C. mixed with the $H_2$ gas, with the partial pressure of the $H_2$ gas being 1.5%, as shown in Table 1.

Further to the sealing step (i.e. the steps 1 and 2), in the evacuating step in the step 3 of FIG. 14, the inner space enclosed by both the substrates and the furnace was evacuated to vacuum, by closing the valves 180 and 210, and opening the valves 200, 190, and 230. Moreover, the temperature of the sealing/evacuating furnace 220 was again increased from 300° C. to 420° C. which was lower than the softening point (by the difference of 30° C.), and maintained at 410° C. for approximately four hours. Subsequently, the temperature inside the furnace was decreased to the room temperature while the furnace was evacuated to vacuum.

In the discharge gas introducing step, the discharge gas of the above-described composition (i.e. 85% Ne-15% Xe) was introduced from the gas introducing device 140 into the inner space enclosed by both the substrate at a pressure of 66 KPa at the room temperature as shown in the step 4 of FIG. 14, by closing the valves 200, 190, 230, and opening the valve 180.

Apart from that, settings in Example 3 are basically the same as Example 1.

Subsequently, two samples were manufactured as PDPs for the comparative examples, as described below and shown in Table 1.

Comparative Example 1

The steps 1 and 2 in the sealing step were performed in the non-oxidizing atmosphere consisting essentially only of $N_2$ with a dew point of −50° C. Apart from that, settings in Comparative Example 1 were the same as Example 1. Thus, the PDP as Comparative Example 1 was obtained.

Comparative Example 2

The steps 1 and 2 in the sealing step were performed in the non-oxidizing atmosphere consisting essentially only of $N_2$ with the dew point of −55° C. Apart from that, settings in Comparative Example 2 were the same as Example 3. Thus, the PDP as Comparative Example 2 was obtained.

Examples 1 to 3 and Comparative Examples 1 and 2 manufactured as described above are called Samples 1 to 5. Table 1 collectively shows, for each of the Samples 1 to 5, various data and a value of the firing voltage Vf. The various data includes (i) a type of the protective layer, (ii) a type, the softening point, and the flow point (sealing temperature) of the sealing material, (iii) the pre-baking temperature of the sealing material, (iv) a type, a mixture ratio, and a dew point (temperature) of the mixed gas consisting of the non-oxidizing dry gas mixed with the reducing gas within the sealing/evacuating furnace, (v) an amount of the mixed gas consisting essentially of the non-oxidizing dry gas mixed with the reducing gas that is caused to flow at the time of sealing, and (vi) the evacuation temperature at the time of evacuating to vacuum. In any of the Samples 1 to 5, the highest pre-baking temperature in the pre-baking step was set to a temperature lower than the softening point of the sealing material.

TABLE 1

| | Composition of protective layer of front panel | Composition, softening point, and sealing temperature (frow point) of sealing material in application step and pre-baking step for sealing material | Pre-baking temperature in application step and pre-baking step for sealing material (difference from softening point of sealing meterial) | Composition and dew point*1 of gas within sealing/evacuating furnace and panel in sealing step | Amount of gas caused to flow*2 into panel in step 1 (temperature increasing step) in sealing step |
|---|---|---|---|---|---|
| Sample 1 (Example 1) | MgO | PbO—$B_2O_3$—RO-MO-based<br>Softening point 430° C.<br>Flow point 490° C. | 400° C.<br>(−30° C.) | $N_2$ (99.9%)<br>$H_2$ (0.1%)<br>−50° C. | 5 l/min |
| Sample 2 (Example 2) | Same as above | Same as above | Same as above | $N_2$ (97%)<br>$H_2$ (3%)<br>−50° C. | Same as above |

TABLE 1-continued

| | | | | | |
|---|---|---|---|---|---|
| Sample 3 (Example 3) | MgO added with 100 ppm of $SiO_2$ and 500 ppm of $Al_2O_3$ | $Bi_2O_3$—$B_2O_3$—RO-MO-based Softening point 450° C. Flow point 500° C. | 410° C. (−40° C.) | $N_2$ (98.5%) $H_2$ (1.5%) −55° C. | 4 l/min |
| Sample 4 (Comparative Example 1) | MgO | Same as Sample 2 | 400° C. (−30° C.) | $N_2$ (100%) −50° C. | 5 l/min |
| Sample 5 (Comparative Example 2) | Same as Sample 3 | Same as Sample 3 | Same as Sample 3 | $N_2$ (100%) −55° C. | 4 l/min |

| | Amount of gas caused to flow into panel in step 1-2 (temperature increasing step from softening point to flow point of sealing metarial) in sealing step | Highest holding temperature in evacuating step (difference from softening point of sealing material) | Concentration of Xe in discharge gas | Cell pitch (μm) | Firing voltage (Vf) |
|---|---|---|---|---|---|
| Sample 1 (Example 1) | 2 l/min | 410° C. (20° C.) | 100% | 100 μm | 204 V |
| Sample 2 (Example 2) | Same as above | Same as above | Same as above | Same as above | 190 V |
| Sample 3 (Example 3) | 3 l/min | 420° C. (30° C.) | 15% | 150 μm | 180 V |
| Sample 4 (Comparative Example 1) | 2 l/min | 410° C. (20° C.) | 100% | 100 μm | 214 V |
| Sample 5 (Comparative Example 2) | Same as Sample 3 | Same as Sample 3 | 15% | 150 μm | 195 V |

*[1]The type and the dew temperature of the mixed gas consisiting essentially of $N_2$ mixed with the reducing gas that is caused to flow into the sealing/evacuating furnace and the panel in the steps 1and 2 in the sealing step.
*[2]The amount of gas caused to flow until the temperature of the panels increases from the room temperature to the softening point of the sealing glass.

(Consideration of Results)

As shown in Table 1, in all of Examples 1 and 2, and Comparative Example, the PbO-based glass of similarity was used as the sealing material, and MgO was used as the protective layer in the front substrate manufacturing step. It can be acknowledged that, although under the above common structures, Samples of Examples 1 and 2, with the sealing step having been performed in the sealing atmosphere (mixed gas atmosphere) consisting essentially of the non-oxidizing gas mixed with the reducing gas, more clearly exhibits the reducing effect of the firing voltage Vf, compared with Sample of Comparative Example 1 having used only the non-oxidizing $N_2$ gas as the sealing atmosphere.

The reason is supposed as follows. Since, in Comparative Example 1, the sealing step was performed in the sealing atmosphere consisting essentially only of $N_2$, the organic components of the sealing material paste burnt by contact with a small amount of oxygen which still remained in the sealing step. This generated the impurities, such as the polymer components, which were turned into the gas to be absorbed into the protective layer, deteriorating the protective layer. As a result, the voltage was increased. On the other hand, in Examples 1 and 2, the sealing step was performed in the sealing atmosphere consisting essentially of $N_2$ mixed with the reducing gas, the generation of the polymer components was suppressed, and the organic components were fully removed still as the low molecular components in the evacuating step. As a result, the deterioration of the protective layer was effectively prevented. In other words, Examples 1 and 2 both provided the favorable reducing effect of the drive voltage by mixing the reducing gas with $N_2$ in the sealing atmosphere.

Next, a comparison is made between Example 1 and Example 2. The reducing effect of the firing voltage Vf is more effectively achieved in Example 2 in which the reducing gas was added to the sealing atmosphere at the partial pressure of 3.0%, compared with Example 1 in which the reducing gas was added to the sealing atmosphere at the partial pressure of only 0.1%. As can be seen from the results of Examples 1 and 2, as for the amount of the reducing gas to be added, 3% or so is more preferable than 0.1% to achieve the better reducing effect, although the effect can be reasonably achieved even by adding a slight amount of the reducing gas. Accordingly, it can be said that the amount of the reducing gas to be added to the sealing atmosphere preferably falls in a range from 0.1% to 3% inclusive, and even more preferably, the partial pressure of the reducing gas should be set as large as possible within the range.

Next, a comparison is made between Example 3 and Comparative Example 2. In both Example 3 and Comparative Example 2, the bismuth ($Bi_2O_3$)-based glass was used as the sealing material, 100 ppm of $SiO_2$ and 500 ppm of $Al_2O_3$ were added to MgO as the compositions of the protective layer in the front substrate manufacturing step. It was acknowledged that, even with the above compositions of the sealing material and the protective layer in the front substrate manufacturing step different from Examples 1 and 2, by using the sealing atmosphere consisting essentially of the non-oxidizing gas mixed with the reducing gas in the sealing step, Sample (Example 3) provided a more favorable reducing effect of the firing voltage Vf than Sample (Comparative Example 2) using only the non-oxidizing $N_2$ gas as the sealing atmosphere. The reason of the above result is supposed to be the same as that described in the consideration of Examples 1 and 2 and Comparative Example 2. It is also considered that, as the requirements of the present invention, it is important to utilize the sealing atmosphere consisting essentially of the non-oxidizing gas mixed with the reducing gas at the predetermined ratios.

Furthermore, Samples of Examples 1 and 2, and Comparative Example 1 have small cells with a cell pitch of 0.10 mm, as shown in Table 1. From the above results, the present invention is expected to enable even the PDPs having high-definition cells with a small cell pitch to effectively reduce the electric power consumption.

The above results confirmed superiority of the present invention.

Meanwhile, in the experiment, the $N_2$ gas was used as the non-oxidizing gas, and the $H_2$ gas was used as the reducing gas to perform the steps 1 and 2 in the sealing step. However, the similar effect is expected to be achieved by using the Ar gas and the Xe gas as the non-oxidizing gas, and using $NH_3$ as the reducing gas.

<Other Remarks>

The above embodiment is described with the panel with a resolution of FHD or higher in which the effects of the present invention are most remarkably provided. Needless to say, however, the same effects are also achieved in other panels with a resolution of ultra-high-definition, such as SD, HD, and FHD.

Furthermore, the present invention is not limited to the above-described high-definition and ultra-high-definition panels. For example, the present invention provides good effects even when applied to a large-sized panel (of at least the 50 inch visual size) having a relatively large number of scan lines, since such a large-sized panel needs to be driven at a high speed.

Moreover, the application of the present invention is not limited to the high-definition and ultra-high-definition panels or the large-sized panel, and can be applied to a PDP having a relatively large discharge cells configured in accordance with XGA and SXGA standards.

INDUSTRIAL APPLICABILITY

As mentioned above, it can be said that the present invention is effective for providing high-definition PDP apparatuses with a large-sized panel, and highly applicable as televisions for use in public facilities, homes, and so forth.

| | |
|---|---|
| 1, 101 | plasma display panel (PDP) |
| 2 | front substrate (front panel) |
| 3 | front substrate glass |
| 8 | protective layer |
| 9 | back substrate (back panel) |
| 10 | back substrate glass |
| 13 | barrier rib |
| 16 | sealing portion |
| 31 | glass tube (tip tube) |
| 111 | scan electrode drive circuit |
| 112 | sustain electrode drive circuit |
| 113 | data (address) electrode drive circuit |
| 140 | gas introducing device |
| 160 | evacuating device |
| 180, 190, 200, 210, 230 | valve |
| 220 | sealing/evacuating furnace |
| 260 | heater |
| 1000 | PDP apparatus |

The invention claimed is:

1. A manufacturing method for a plasma display panel that includes a front substrate and a back substrate, the front substrate having a MgO-containing protective layer on a main surface thereof, the manufacturing method comprising:

a pre-baking step of pre-baking a paste containing a sealing material and a binder at a pre-baking temperature, a highest pre-baking temperature being set to be higher than or equal to a disappearance point of the binder and lower than a softening point of the sealing material, the paste having been applied along peripheral edges of one of the front and the back substrates;

a positioning step of superposing, after the pre-baking step, one of the front and the back substrates on the other via the pre-baked paste so that the protective layer opposes a main surface of the back substrate with a gap therebetween;

a sealing step of sealing, after the positioning step, the substrates together along the peripheral edges thereof to enclose an inner space between the substrates, by baking the substrates in a mixed gas atmosphere consisting essentially of a non-oxidizing gas and a reducing gas; and an evacuating step of evacuating the inner space after the sealing step, wherein the pre-baking step includes:

a first decreasing sub-step of decreasing a temperature of the substrate applied with the paste to a first temperature after pre-baking the paste at the highest pre-baking temperature, the first temperature being lower than the disappearance point of the binder and higher than a room temperature; and a second decreasing sub-step of decreasing, after the first decreasing sub-step, the temperature of the substrate applied with the paste from the first temperature to the room temperature, a temperature decreasing rate in the first decreasing sub-step is 400° C./hr or higher, a time required for the first decreasing sub-step falls in a range from 20 to 30 minutes inclusive and is shorter than a time required for the second decreasing sub-step, and a temperature decreasing rate in the second decreasing sub-step is 75° C./hr or lower.

2. The manufacturing method of claim 1, wherein the first temperature is 200° C.

3. The manufacturing method of claim 1, wherein the time required for the second decreasing sub-step is at least five times longer than the time required for the first decreasing sub-step.

4. The manufacturing method of claim 1, wherein the highest pre-baking temperature is at least 10° C. lower than the softening point.

5. The manufacturing method of claim 1, wherein the highest pre-baking temperature is lower than the softening point by a difference of 10° C. to 50° C. inclusive.

6. The manufacturing method of claim 1, wherein in the pre-baking step, the sealing material contained in the paste includes low-melting glass, and the pre-baking temperature is higher than or equal to a glass-transition point of the low-melting glass and at least 10° C. lower than the softening point of the low-melting glass.

7. The manufacturing method of claim 1, wherein in the sealing step, the sealing temperature is at least 40° C. higher than the softening point.

8. The manufacturing method of claim 1, wherein in the sealing step, a $N_2$ gas or an Ar gas is used as the non-oxidizing gas, and a $H_2$ gas is used as the reducing gas.

9. The manufacturing method of claim 8, wherein a partial pressure of the $H_2$ gas contained in the mixed gas atmosphere falls in a range from 0.1% to 3% inclusive.

10. The manufacturing method of claim 1, wherein the pre-baking step is performed in a $N_2$ atmosphere with a dew point of −45° C. or lower.

11. The manufacturing method of claim 1, wherein the pre-baking step is performed in a $N_2$ atmosphere containing $O_2$ at a partial pressure higher than 0% and lower than or equal to 1%.

12. The manufacturing method of claim 1, wherein the sealing step at least includes:

a sealing temperature increasing sub-step of increasing a temperature of the substrates from a room temperature to the sealing temperature;

a sealing temperature maintaining sub-step of maintaining, after the sealing temperature increasing sub-step, the sealing temperature for a predetermined period of time; and a sealing temperature decreasing sub-step of decreasing, after the sealing temperature maintaining sub-step, the temperature of the substrates from the sealing temperature to a temperature lower than the softening point.

13. The manufacturing method of claim 1, wherein the evacuating step includes:

an evacuation temperature maintaining sub-step of maintaining a temperature of the substrates for a predetermined period of time at a temperature lower than or equal to a room temperature and lower than the softening point; and an evacuation temperature decreasing sub-step of decreasing, after the evacuation temperature maintaining sub-step, the temperature of the substrates to the room temperature, and the evacuation temperature maintaining sub-step and the evacuation temperature decreasing sub-step are sequentially performed in an atmosphere in a depressurized state.

14. The manufacturing method of claim 1, wherein prior to the sealing step, barrier ribs are installed on the main surface of the back substrate at pitches of 0.16 mm or less, and a phosphor layer is formed between each of the barrier ribs, and after the evacuating step, a discharge gas containing Xe at a partial pressure of 15% or higher is introduced into the inner space.

15. The manufacturing method of claim 1, wherein prior to the sealing step, barrier ribs are installed on the main surface of the back substrate at pitches that have been determined so that the number of pixels is at least 1920 horizontally and at least 1080 vertically, and a phosphor layer is formed between each of the barrier ribs, and after the evacuating step, a discharge gas containing Xe at a partial pressure of 15% or higher is introduced into the inner space.

* * * * *